US010520240B2

(12) United States Patent
Jung et al.

(10) Patent No.: US 10,520,240 B2
(45) Date of Patent: Dec. 31, 2019

(54) DEFROSTING DEVICE AND REFRIGERATOR HAVING THE SAME

(71) Applicant: LG ELECTRONICS INC., Seoul (KR)

(72) Inventors: Kwangsoo Jung, Seoul (KR); Woocheol Kang, Seoul (KR); Yonggap Park, Seoul (KR); Geunhyung Lee, Seoul (KR); Jongmin Lee, Seoul (KR); Hyunwoo Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/518,502

(22) PCT Filed: Aug. 1, 2016

(86) PCT No.: PCT/KR2016/008436
§ 371 (c)(1),
(2) Date: Apr. 12, 2017

(87) PCT Pub. No.: WO2017/069386
PCT Pub. Date: Apr. 27, 2017

(65) Prior Publication Data

US 2018/0283766 A1 Oct. 4, 2018

(30) Foreign Application Priority Data

Oct. 21, 2015 (KR) ..... 10-2015-0147010
Oct. 21, 2015 (KR) ..... 10-2015-0147011
Oct. 21, 2015 (KR) ..... 10-2015-0147012

(51) Int. Cl.
*F25D 21/08* (2006.01)
*F28F 1/40* (2006.01)
(Continued)

(52) U.S. Cl.
CPC ..... *F25D 21/08* (2013.01); *F25B 39/02* (2013.01); *F25B 47/02* (2013.01); *F25D 21/12* (2013.01);
(Continued)

(58) Field of Classification Search
CPC ..... F25D 21/06; F25D 21/04; F25D 21/08; F28D 15/02; F25B 2400/01; F25B 39/02
See application file for complete search history.

(56) References Cited

U.S. PATENT DOCUMENTS 2,631,442 A 3/1953 Cyril
2,635,439 A * 4/1953 Philipp ..... F25D 21/002 62/156
(Continued)

FOREIGN PATENT DOCUMENTS

CN 102016462 4/2011
EP 3343135 7/2018
(Continued)

OTHER PUBLICATIONS

International Search Report in International Application No. PCT/KR2016/008436, dated Nov. 16, 2016, 12 pages.
(Continued)

*Primary Examiner* — Kun Kai Ma
(74) *Attorney, Agent, or Firm* — Fish & Richardson P.C.

(57) ABSTRACT

The present disclosure discloses a defrosting device, including a heating unit provided in an evaporator; and a heat pipe, both end portions of which are connected to an inlet and an outlet of the heating unit, respectively, and at least part of which is disposed adjacent to a cooling tube to dissipate heat to the cooling tube of the evaporator due to high-temperature working fluid heated and transferred by the heating unit, wherein the heating unit includes a heater case provided with a vacant space therein, and provided with the inlet and
(Continued)

the outlet at positions separated from each other, respectively, along a length direction; and a heater attached to an outer surface of the heater case to heat working fluid within the heater case.

13 Claims, 29 Drawing Sheets

(51) Int. Cl.

| | |
|---|---|
| ***F25B 39/02*** | (2006.01) |
| ***F25B 47/02*** | (2006.01) |
| ***F28F 1/12*** | (2006.01) |
| ***F28D 15/02*** | (2006.01) |
| ***F28F 19/00*** | (2006.01) |
| ***F25D 21/12*** | (2006.01) |
| ***F28D 7/00*** | (2006.01) |
| ***F25D 21/04*** | (2006.01) |
| ***F28D 1/047*** | (2006.01) |
| ***F28F 1/24*** | (2006.01) |

(52) U.S. Cl.
CPC ..... *F28D 7/0016* (2013.01); *F28D 15/0208* (2013.01); *F28D 15/0266* (2013.01); *F28F 1/12* (2013.01); *F28F 1/40* (2013.01); *F28F 19/006* (2013.01); *F25B 2400/01* (2013.01); *F25D 21/04* (2013.01); *F28D 1/0477* (2013.01); *F28D 2015/0216* (2013.01); *F28F 1/24* (2013.01)

(56) References Cited

U.S. PATENT DOCUMENTS

| | | | | | |
|---|---|---|---|---|---|
| 2,781,646 | A * | 2/1957 | Buchanan | F25B 47/022 | 62/276 |
| 3,100,969 | A * | 8/1963 | Elfving | F25B 21/02 | 165/104.21 |
| 4,087,987 | A * | 5/1978 | Schumacher | F25D 21/002 | 62/174 |
| 4,492,851 | A * | 1/1985 | Carr | F25D 21/08 | 165/181 |
| 4,649,713 | A * | 3/1987 | Bezek | F25D 21/02 | 324/640 |
| 4,716,275 | A * | 12/1987 | Waldschmidt | F25D 21/08 | 219/201 |
| 5,731,568 | A * | 3/1998 | Malecek | B60H 1/00278 | 180/68.5 |
| 6,230,511 | B1 * | 5/2001 | Lee | F25D 17/062 | 165/179 |
| 2004/0079089 | A1 * | 4/2004 | Wallach | A61M 1/369 | 62/3.2 |
| 2004/0200597 | A1 * | 10/2004 | Cho | F25D 21/08 | 165/64 |
| 2010/0193498 | A1 * | 8/2010 | Walsh | F24H 3/002 | 219/217 |
| 2011/0073586 | A1 | 3/2011 | Lim et al. | | |
| 2015/0048073 | A1 * | 2/2015 | Chiu | G06F 1/18 | 219/209 |
| 2015/0183295 | A1 * | 7/2015 | Trapp | F24H 3/0429 | 392/360 |
| 2018/0245826 | A1 * | 8/2018 | Jung | F25B 39/02 | |

FOREIGN PATENT DOCUMENTS

| | | | |
|---|---|---|---|
| JP | 1986240079 | | 10/1986 |
| JP | 1993087475 | | 4/1993 |
| JP | 1995083558 | | 3/1995 |
| JP | 08-313144 | | 11/1996 |
| JP | 1996303932 | | 11/1996 |
| JP | 1997264657 | | 10/1997 |
| JP | 2003249334 | | 9/2003 |
| JP | 2003279220 | | 10/2003 |
| JP | 2005283014 | | 10/2005 |
| JP | 2013016589 | | 1/2013 |
| JP | 2013016589 | A * | 1/2013 |
| JP | 2013053766 | | 3/2013 |
| JP | 6355762 | | 7/2018 |
| KR | 20030068931 | | 8/2003 |
| KR | 100469322 | | 2/2005 |
| KR | 20090102298 | | 9/2009 |
| KR | 20100001721 | | 1/2010 |
| KR | 20110121862 | A * | 11/2011 |
| KR | 1020110121862 | | 11/2011 |
| KR | 10-1125827 | | 3/2012 |

OTHER PUBLICATIONS

Chinese Office Action in Chinese Appln. No. 201680003731.9, dated Dec. 28, 2018, 12 pages (with English translation).
Extended European Search Report in European Application No. 16857644.5, dated Apr. 26, 2019, 8 pages.

* cited by examiner (a) (b)

DEFROSTING DEVICE AND REFRIGERATOR HAVING THE SAME

CROSS REFERENCE TO RELATED APPLICATIONS

This application is a U.S. National Phase Application under 35 U.S.C. § 371 of International Application PCT/KR2016/008436, filed on Aug. 1, 2016, which claims the benefit of Korean Application No. 10-2015-0147010, filed on Oct. 21, 2015, Korean Application No. 10-2015-0147011, filed on Oct. 21, 2015, and Korean Application No. 10-2015-0147012, filed on Oct. 21, 2015, the entire contents of which are hereby incorporated by reference in their entireties.

TECHNICAL FIELD

The present disclosure relates to a defrosting device for removing frost formed on an evaporator provided in a refrigeration cycle, and a refrigerator having the same.

BACKGROUND ART

An evaporator provided in a refrigeration cycle decreases ambient temperature using cool air generated by the circulation of coolant flowing through a cooling tube. During the process, when there occurs a temperature difference from ambient air, a phenomenon of condensing and freezing moisture in the air on a surface of the cooling tube occurs.

A defrosting method using an electric heater has been used for a defrosting process for removing frost formed on an evaporator in the related art.

In recent years, a defrosting device using a heat pipe has been developed and contrived, and the related technologies include Korean Patent Registration No. 10-0469322, entitled "Evaporator."

A heat pipe type defrosting device in the aforementioned patent "Evaporator" has a configuration in which a heater is vertically disposed in the top-down direction of the evaporator, and working fluid is filled only into a bottom portion of the heater. The defrosting device with the foregoing structure may increase the evaporation speed due to rapid heating but has a danger of overheating the heater.

Furthermore, it has a structure in which the heater is accommodated into the heat pipe, and thus high-temperature heat may be concentrated on an inside of the heat pipe, thereby reducing the lifespan of the heater as well as causing the sealing problem of the heater.

DISCLOSURE OF THE INVENTION

An aspect of the present disclosure is to provide a defrosting device with a new structure that can be fabricated at lower cost capable of reducing power consumption during defrosting, and facilitating maintenance.

Another aspect of the present disclosure is to provide a defrosting device capable of enhancing the heat transfer performance of a heater as well as preventing the overheating of the heater to enhance reliability.

Still another aspect of the present disclosure is to provide a defrosting device capable of preventing working fluid from being brought into contact with a heater.

Yet still another aspect of the present disclosure is to provide a defrosting device capable of efficiently circulating working fluid.

Still yet another aspect of the present disclosure is to provide a structure of efficiently carrying out defrosting for a lower cooling tube of an evaporator in a defrosting device in which a heating unit is vertically disposed along the top-down direction of the evaporator.

In order to accomplish the foregoing tasks of the present disclosure, a defrosting device according to the present disclosure may include a heating unit provided in an evaporator; and a heat pipe, both end portions of which are connected to an inlet and an outlet of the heating unit, respectively, and at least part of which is disposed adjacent to a cooling tube to dissipate heat to the cooling tube of the evaporator due to high-temperature working fluid heated and transferred by the heating unit, wherein the heating unit includes a heater case provided with a vacant space therein, and provided with the inlet and the outlet at positions separated from each other, respectively, along a length direction; and a heater attached to an outer surface of the heater case to heat working fluid within the heater case.

The heater may be a plate-shaped heater having a plate shape.

The heater may include a base plate formed of a ceramic material, and attached to an outer surface of the heater case; a hot wire formed on the base plate, and configured to dissipate heat during the application of power; and a terminal provided on the base plate to electrically connect the hot wire to the power.

The heater case may be divided into an active heating part corresponding to a portion on which the hot wire is disposed and a passive heating part corresponding to a portion on which the hot wire is not disposed, and the inlet may be formed on the passive heating part to prevent working fluid being moved through the heat pipe and then returned through the inlet from being reheated to flow backward.

The hot wire may be extended and formed from one point between the inlet and the outlet toward the outlet.

The present disclosure discloses a first through a fourth embodiment of a defrosting device based on the structure.

First Embodiment

The heater may be attached to a bottom surface of the heater case.

A first and a second extension fin extended and formed downward from a bottom surface and configured to cover both lateral surfaces of the heater attached to the bottom surface may be provided at both sides of the heater case, respectively.

A sealing member may be filled to cover the heater on a rear surface of the heater and a recessed space formed by the first and the second extension fin.

An insulating material may be interposed between the rear surface of the heater and the sealing member.

A thermal conductive adhesive may be interposed between the heater case and the heater.

The heater case may include a main case provided with a vacant space therein, both end portions of which have an open shape, and to a bottom surface of which the heater is adhered; and a first cover and a second cover mounted to cover both open end portions of the main case, respectively.

At least one of the first and the second cover may be extended and formed downward from a bottom surface of the main case, and configured to surround the heater along with the first and the second extension fins.

When the heat pipe is configured with a first heat pipe and a second heat pipe disposed to form two rows on a front portion and a rear portion of the evaporator, respectively, the outlet may include a first outlet and a second outlet connected to an end portion of the first and the second heat pipe, respectively, and the inlet may include a first inlet and a second inlet connected to the other end portion of the first and the second heat pipe, respectively.

The first and the second outlet may be formed at both sides of the main case, respectively, or formed in parallel to each other to the first cover.

The first and the second inlet may be formed at both sides of the main case, respectively, or folioed in parallel to each other to the second cover.

On the other hand, an outer fin may be protruded and formed on another outer surface of the heater case to which the heater is not adhered.

The heater may be attached to a bottom surface of the heater case, and the outer fin may be formed on an upper surface of the heater case.

A plurality of outer fins may be provided thereon, and extended and formed along a length direction or width direction of the heater case with a predetermined separation distance from each other. The separation distance may be set to be the same as or larger than a width of the outer fin.

Alternatively, the plurality of outer fins may be provided thereon, and disposed with a predetermined separation distance from each other along a length direction and a width direction of the heater case to form a matrix.

In a structure in which the first and the second outlet are formed on both lateral surfaces, respectively, adjacent to one end portion of the main case, and the first and the second inlet are formed on both lateral surfaces, respectively, adjacent to the other end portion of the main case, the outer fin may be protruded and formed on both outer surfaces of the main case, respectively, but extended and formed between the first inlet and the first outlet and the second inlet and the second outlet in an elongated manner.

The outer fin may be also protruded and formed on an outer surface of at least one of the first and the second cover.

On the other hand, an inner fin may be protruded and formed on an inner surface at an inner side of the outer surface to which the heater is adhered.

The heater may be attached to an outer bottom surface of the heater case, and the inner fin may be protruded and formed from an inner bottom surface of the heater case.

The inner fin may be protruded and formed with a length less than ½ compared to an inner height of the heater case.

A plurality of inner fins may be provided thereon, and extended and formed along a length direction of the heater case with a predetermined separation distance from each other.

A distance from an inner wall of the heater case to the inner fin adjacent to the inner wall may be formed to be greater than one time but less than two times compared to a width of the inner fin.

A separation distance between each other of the plurality of inner fins may be formed to be greater than one time but less than two times compared to the width of the inner fin.

In a structure in which the first and the second outlet are formed on both lateral surfaces, respectively, adjacent to one end portion of the main case, and the first and the second inlet are formed on both lateral surfaces, respectively, adjacent to the other end portion of the main case, the inner fin may be extended and formed between the first inlet and the first outlet and the second inlet and the second outlet in an elongated manner.

On the other hand, it is configured such that the lead wire is extended outward from one end portion of the heater adjacent to an outer side of the evaporator.

In a structure in which the heating unit is disposed at a left bottom portion of the evaporator, it is configured such that the lead wire is extended outward from a left end portion of the heater adjacent to the left side of the evaporator.

In this case, the terminal connected to the lead wire may be located at a left end portion of the heater.

In a structure in which the heating unit is disposed at a right bottom portion of the evaporator, it is configured such that the lead wire is extended outward from a right end portion of the heater adjacent to the right side of the evaporator.

In this case, a right end portion of the heater may be disposed between the inlet and the outlet of the heater case, and the terminal connected to the lead wire may be located between the inlet and the outlet adjacent to the inlet of the heater case.

On the other hand, the outlet may be formed at a position separated backward from a front end of the heater case with a predetermined distance in such a manner that to part of working fluid remains at a front end portion of the heater case to be brought into contact with the heater.

Furthermore, an inner diameter of a return portion of the heat pipe connected to the inlet of the heater case may be formed to be greater than 5 mm but less than 7 mm.

On the other hand, the heater case may be disposed such that an end portion of the inlet side has an angle range greater than −90° but less than 2° with respect to an end portion of the outlet side.

Moreover, in consideration of a flow direction of working fluid and a rising characteristic of heated working fluid, the return portion may be disposed in parallel to the heater case or extended and formed in a downward direction of the heater case, and an entrance portion of the heat pipe connected to an outlet of the heater case may be disposed in parallel to the heater case or extended and formed in an upward direction of the heater case.

Second Embodiment

It is configured such that the heater case is vertically disposed along a top-down direction at an outer side of a support fixture provided at one side of the evaporator, and the heater is located lower than a water level of working fluid filled into the heater case when the working fluid is all in a liquid phase.

The heater may be attached to an opposite surface to one surface of the heater case facing the support fixture.

Third Embodiment

It is configured such that the heat pipe is repeatedly bent in a zigzag shape to form a plurality of columns, and a distance between each column disposed at a lower portion of the heat pipe is smaller than that between each column disposed at an upper portion thereof.

A distance between each column disposed at a lower portion of the first heat pipe at a front side of the evaporator may be formed to be smaller than that between each column disposed at an upper portion thereof, and a distance between each column disposed at an upper portion of the second heat pipe at a rear side of the evaporator may be formed to be smaller than that between each column disposed at a lower portion thereof.

Alternatively, a distance between each column disposed at a lower portion of the first heat pipe at a front side of the evaporator may be formed to be larger than that between each column disposed at an upper portion thereof, and a distance between each column disposed at an upper portion of the second heat pipe at a rear side of the evaporator may be formed to be larger than that between each column disposed at a lower portion thereof.

Fourth Embodiment

The heat pipe may include an evaporation unit connected to an outlet of the heating unit, and disposed to correspond to the cooling tube to transfer heat to the cooling tube; and a condensing unit extended from the evaporator and disposed lower than the lowest column of the cooling tube, and connected to an inlet of the heating unit.

According to the foregoing structure, a lower end of the heating unit may be disposed adjacent to the lowest column of the cooling tube.

Alternatively, at least part of the heating unit may be disposed lower than the lowest column of the cooling tube.

According to present disclosure, it is configured such that the heater is attached to an outer surface of the heater case to heat working fluid within the heater case, thereby facilitating maintenance during the failure of the heater compared to a structure in which the heater is accommodated into the heater case. Furthermore, when a plate-shaped ceramic heater is applied to the heater, it may be possible to implement a defrosting device with a high efficiency at a lower cost.

When an outer fin is formed on an outer surface of the heater case in the defrosting device, an outer area of the heater case may increase, thereby enhancing heat exchange efficiency between ambient low-temperature air and the heater case.

Moreover, when an inner fin is formed at an inner portion of the heater case in the defrosting device, a contact area to working fluid filled into the heater case may increase, thereby increasing a heat transfer rate of being transferred from the heater to working fluid. Furthermore, the entire volume of the heater case may increase to increase heat capacity capable of receiving heat from the heater case, thereby receiving more heat generated from the heater. As a result, it may be possible to enhance defrosting performance.

When outer fins and/or inner fins are formed as described above, a large amount of heat generated from the heater may be transferred to the heater case at a front side of the heater to prevent the overheating of the heater, and the temperature of a rear portion of the heater may decrease to enhance the reliability and lifespan of the heater.

Furthermore, according to the defrosting device, the sealing structure of the heater may be implemented by a structure in which the heater is attached to a bottom surface of the heater case, and a first and a second extension fin at both sides of the heater case are respectively extended and formed downward from the bottom surface, and a sealing member is filled into a recessed space formed by a rear surface of the heater and the first and the second extension fin.

Moreover, a return portion connected to the inlet of the heating unit may have an inner diameter greater than 5 mm but less than 7 mm. In this case, working fluid being returned may be efficiently introduced into the heater case, thereby preventing reheated working fluid from flowing backward.

Furthermore, a structure capable of efficiently forming the flowing of working fluid reheated by the heater and discharged in a gas phase with a rising force while preventing reheated working fluid from flowing backward through a connection structure between the heating unit and the heat pipe for facilitating the flowing of working fluid in consideration of a rising characteristic of heated working fluid.

In addition, when at least two or more columns of low-temperature condensing units of the heat pipe are further disposed lower than the lowest column of the cooling tube of the evaporator in a defrosting device in which the heating unit is vertically disposed along a top-down direction of the evaporator, only a high-temperature evaporation unit may be used for the defrosting of the evaporator, thereby efficiently carrying out defrosting for a lower cooling tube.

According to the foregoing structure, at least part of the heating unit may be disposed lower than the evaporator, and a lower end of the heating unit may be preferably located adjacent to the lowest column of a horizontal pipe of the heating unit. In this case, a filling amount of working fluid may decrease, thereby increasing the temperature of the lowest column of the horizontal pipe of the heating unit up to a defrostable level.

MODES FOR CARRYING OUT THE PREFERRED EMBODIMENTS

Hereinafter, a defrosting device and a refrigerator having the same associated with the present disclosure will be described in more detail with reference to the accompanying drawings.

According to the present specification, the same or similar elements are designated with the same numeral references even in different embodiments and their redundant description will be omitted.

Furthermore, a structure applied to any one embodiment may be also applied in the same manner to another embodiment if they do not structurally or functionally contradict each other even in different embodiments.

A singular representation may include a plural representation as far as it represents a definitely different meaning from the context.

In describing the embodiments disclosed herein, moreover, the detailed description will be omitted when a specific description for publicly known technologies to which the invention pertains is judged to obscure the gist of the present invention.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
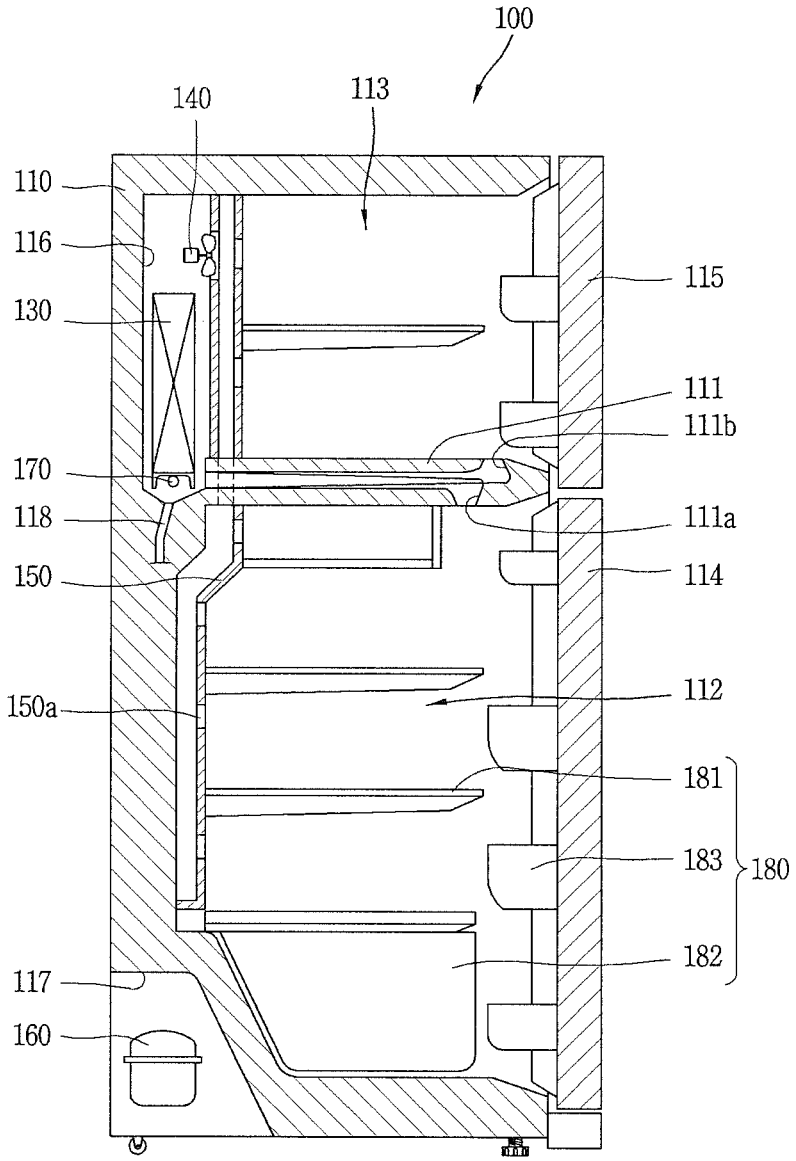
FIG. 1 is a longitudinal cross-sectional view schematically illustrating the configuration of a refrigerator according to an embodiment of the present disclosure.

FIG. 1 is a longitudinal cross-sectional view schematically illustrating the configuration of a refrigerator 100 according to an embodiment of the present disclosure.

The refrigerator 100 is a device for storing foods kept therein at low temperatures using cooling air generated by a less in which the processes of compression-condensation-expansion-evaporation are sequentially carried out.

As illustrated in the drawing, a refrigerator body 110 may include a storage space for storing foods therein. The storage space may be separated by a partition wall 111, and divided into a refrigerating chamber 112 and a freezing chamber 113 according to the set temperature.

According to the embodiment, a top mount type refrigerator in which the freezing chamber 113 is disposed on the refrigerating chamber 112, but the present disclosure may not be necessarily limited to this. The present disclosure may be applicable to a side by side type refrigerator in which the refrigerating chamber and freezing chamber are horizontally disposed, a bottom freezer type refrigerator in which the refrigerating chamber is provided at the top and the freezing chamber is provided at the bottom, and the like.

A door is connected to the refrigerator body 110 to open or close a front opening portion of the refrigerator body 110. According to the present drawing, it is illustrated that a refrigerating chamber door 114 and a freezing chamber door 115 are configured to open or close a front portion of the refrigerating chamber 112 and freezing chamber 113, respectively. The door may be configured in various ways, such as a rotation type door in which a door is rotatably connected to the refrigerator body 110, a drawer type door in which a door is slidably connected to the refrigerator body 110, and the like.

The refrigerator body 110 may include at least one of accommodation units 180 (for example, a shelf 181, a tray 182, a basket 183, etc.) for effectively using an internal storage space. For example, the shelf 181 and tray 182 may be installed within the refrigerator body 110, and the basket 183 may be installed at an inside of the door 114 connected to the refrigerator body 110.

On the other hand, a cooling chamber 116 provided with an evaporator 130 and a blower fan 140 is provided at a rear side of the freezing chamber 113. A refrigerating chamber return duct 111*a* and a freezing chamber return duct 111*b* for inhaling and returning the air of the refrigerating chamber 112 and freezing chamber 113 to the side of the cooling chamber 116 are formed on the partition wall 111. Furthermore, a cool air duct 150 communicating with the freezing chamber 113 and having a plurality of cool air discharge ports 150*a* on a front portion thereof is installed at a rear side of the refrigerating chamber 112.

A machine room 117 is provided at a rear lower side of the refrigerator body 110, and a compressor 160, a condenser (not shown) and the like are provided within the machine room 117.

On the other hand, the process of inhaling the air of the refrigerating chamber 112 and freezing chamber 113 to the cooling chamber 116 through the refrigerating chamber return duct 111*a* and freezing chamber return duct 111*b* of the partition wall 111 by the blower fan 140 of the cooling chamber 116 to perform heat exchange with the evaporator 130, and discharging it to the refrigerating chamber 112 and freezing chamber 113 through the cool air discharge ports 150*a* of the cool air duct 150 again is repeatedly carried out. At this time, frost is formed on a surface of the evaporator 130 due to a temperature difference from circulation air reintroduced through the refrigerating chamber return duct 111*a* and the freezing chamber return duct 111*b*.

A defrosting device 170 is provided in the evaporator 130 to remove such frost, and water removed by the defrosting device 170, namely, defrost water, is collected to a lower defrost water tray (not shown) of the refrigerator body 110 through a defrost water discharge pipe 118.

Hereinafter, a new type of defrosting device 170 capable of reducing power consumption and enhancing heat exchange efficiency during defrost will be described.

Figure 2:
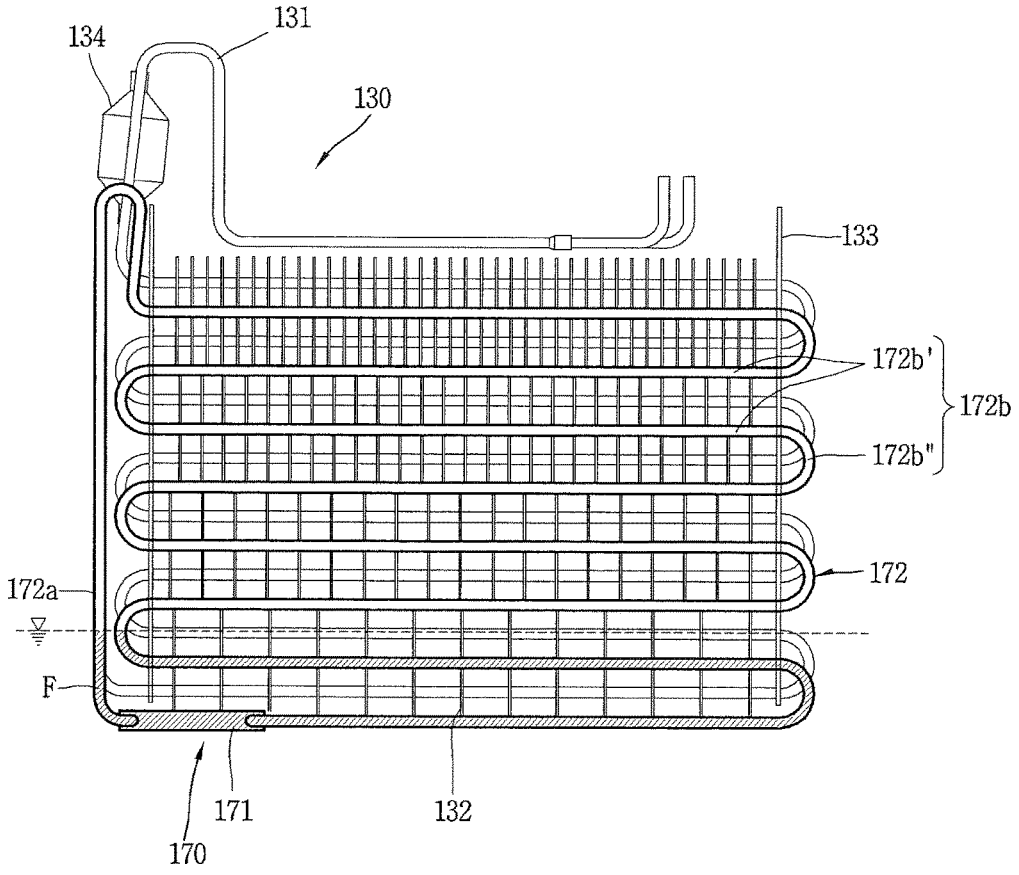
FIGS. 2 and 3 are a front view and a perspective view illustrating a first embodiment of a defrosting device applied to the refrigerator in FIG. 1.
Figure 3:
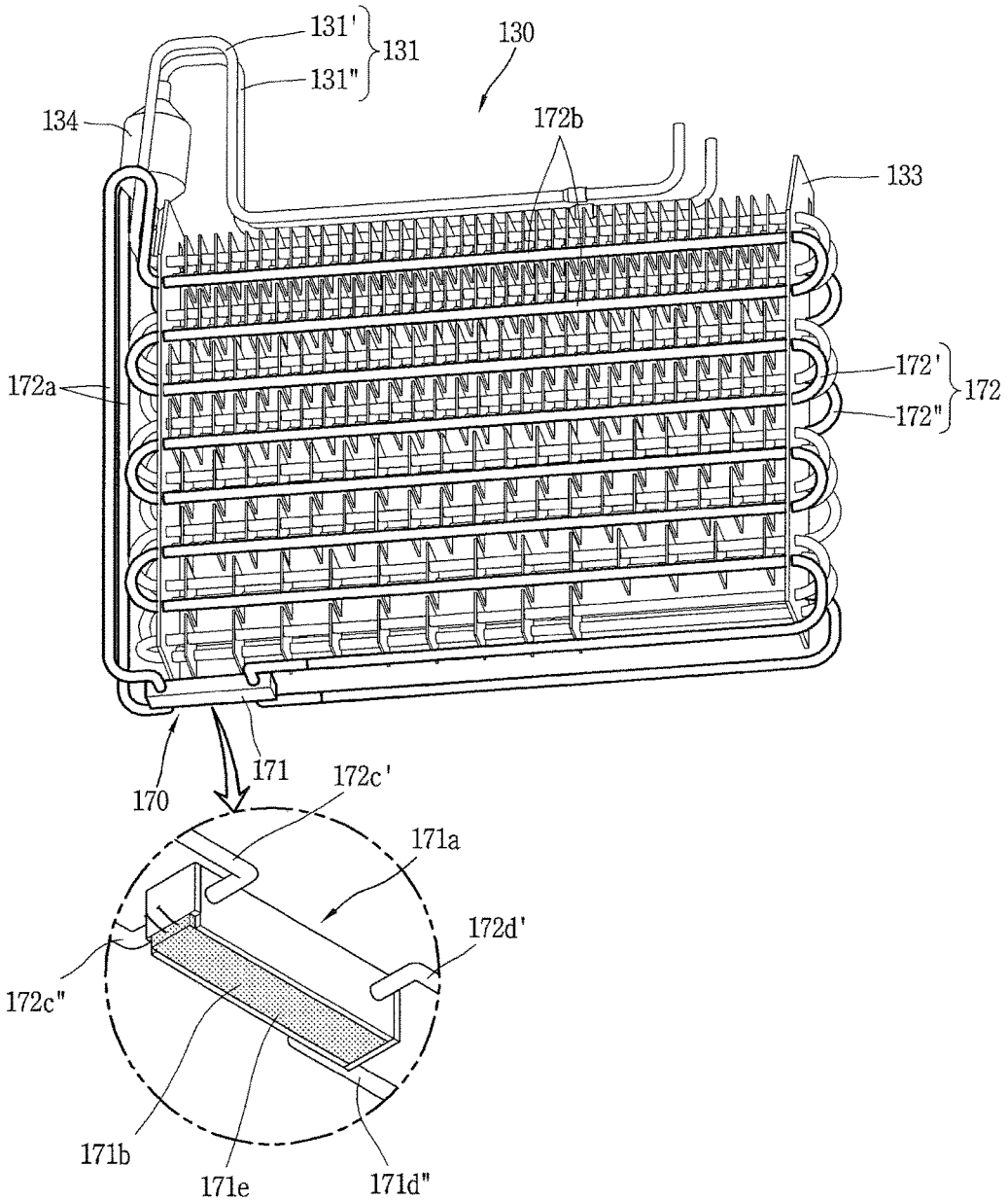

FIGS. 2 and 3 are a front view and a perspective view illustrating a first embodiment of a defrosting device 170 applied to the refrigerator 100 in FIG. 1.

Referring to FIGS. 2 and 3, the evaporator 130 may include a cooling tube 131 (cooling pipe), a plurality of cooling fins 132, and support fixtures 133 at both sides.

The cooling tube 131 is repeatedly bent in a zigzag shape to constitute a plurality of columns, and refrigerant is filled therein. The cooling tube 131 may be formed in an aluminum material.

The cooling tube 131 may be configured in combination with horizontal pipe portions and bending pipe portions. The horizontal pipe portions are horizontally disposed to each other in a vertical direction, and configured to pass through the cooling fins 132, and the bending pipe portions connect an end portion of an upper horizontal pipe portion to an end portion of a lower horizontal pipe portion to communicate their inner portions with each other.

The cooling tube 131 is supported through the support fixture 133 provided at both sides of the evaporator 130. Here, the bending pipe portion of the cooling tube 131 is configured to connect an end portion of an upper horizontal pipe portion to an end portion of a lower horizontal pipe portion at an outer side of the support fixture 133.

Referring to FIG. 3, according to the present embodiment, it is seen that the cooling tube 131 is configured with a first cooling tube 131' and a second cooling tube 131" formed at a front portion and a rear portion of the evaporator 130, respectively, to constitute two columns. For reference, the first cooling tube 131' at a front side thereof and the second cooling tube 131" at a rear side thereof are formed with the same shape, and thus the second cooling tube 131" is hidden by the first cooling tube 131' in FIG. 2.

However, the present disclosure may not be necessarily limited to this. The first cooling tube 131' at a front side thereof and the second cooling tube 131" at a rear side thereof may be formed in different shapes. On another hand, the cooling tube 131 may be formed to constitute a single column.

For the cooling tube 131, a plurality of cooling fins 132 are disposed to be separated at predetermined intervals along an extension direction of the cooling tube 131. The cooling fin 132 may be formed with a flat body made of an aluminum material, and the cooling tube 131 may be flared in the state of being inserted into an insertion hole of the cooling fin 132, and securely inserted into the insertion hole.

A plurality of support fixtures 133 may be provided at both sides of the evaporator 130, respectively, and each of which is configured to support the cooling tube 131 vertically extended and passed through along a vertical direction. An insertion groove or insertion hole to which a heat pipe 172 which will be described later can be inserted and fixed is formed on the support fixture 133.

The defrosting device 170 is provided in the evaporator 130 to remove frost generated from the evaporator 130. The defrosting device 170 may include a heating unit 171 and a heat pipe 172 (heat transfer tube).

The heating unit 171 is provided below the evaporator 130, electrically connected to the controller (not shown), and formed to generate heat upon receiving a drive signal from the controller. For example, the controller may be configured to apply a drive signal to the heating unit 171 for each predetermined time interval or apply a drive signal to the heating unit 171 when the sensed temperature of the cooling chamber 116 is less than a predetermined temperature.

The heat pipe 172 is connected to the heating unit 171 to form a closed loop shaped passage through which working fluid (F) can circulate along with the heating unit 171. The heat pipe 172 is formed of an aluminum material.

The heat pipe 172 may include a first heat pipe 172' and a second heat pipe 172" disposed to constitute two columns at a front and a rear portion of the evaporator 130. According to the present example, it is seen a structure in which the first heat pipe 172' is disposed at a front side of the first cooling tube 131', and the second heat pipe 172" is disposed at a rear side of the second cooling tube 131" to constitute two columns.

For the working fluid (F), refrigerant (for example, R-134a, R-600a, etc.) that exists in the liquid phase in a freezing condition of the refrigerator 100, but is phase-changed into the gas phase to perform the role of transferring heat when heated may be used.

Figure 4:
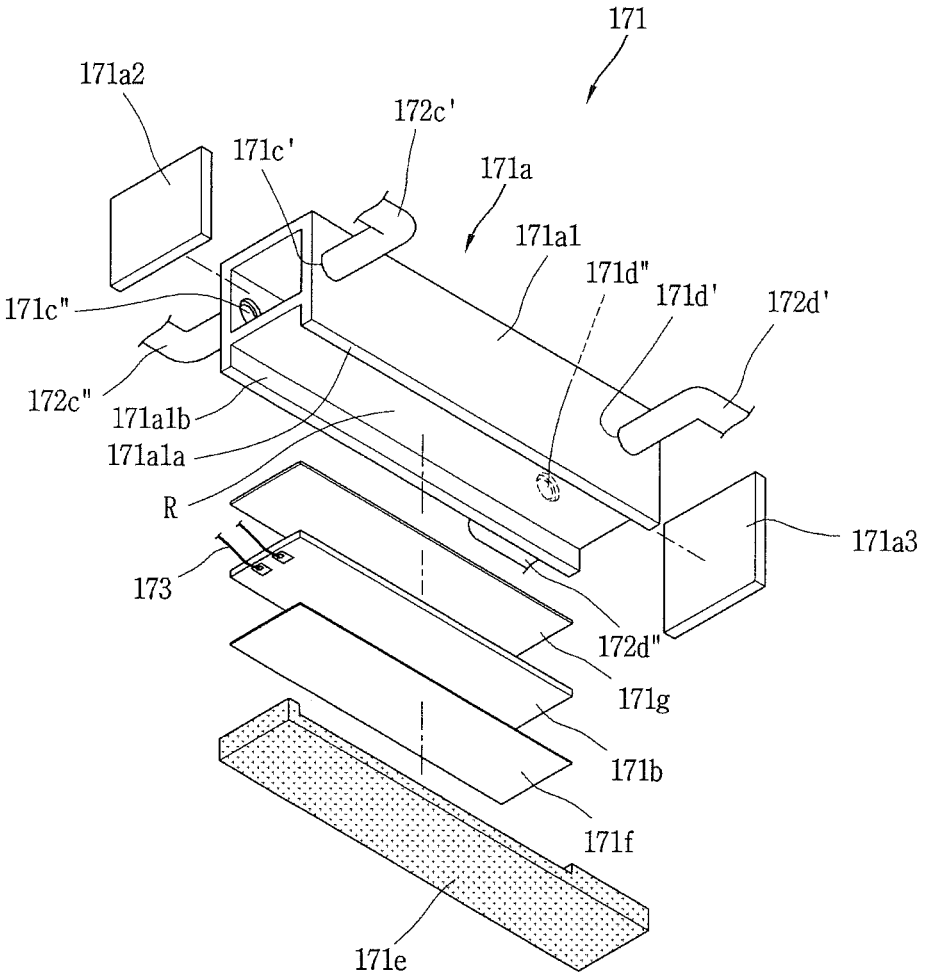
FIG. 4 is an exploded perspective view illustrating an example of a heating unit illustrated in FIG. 3.
Figure 5:
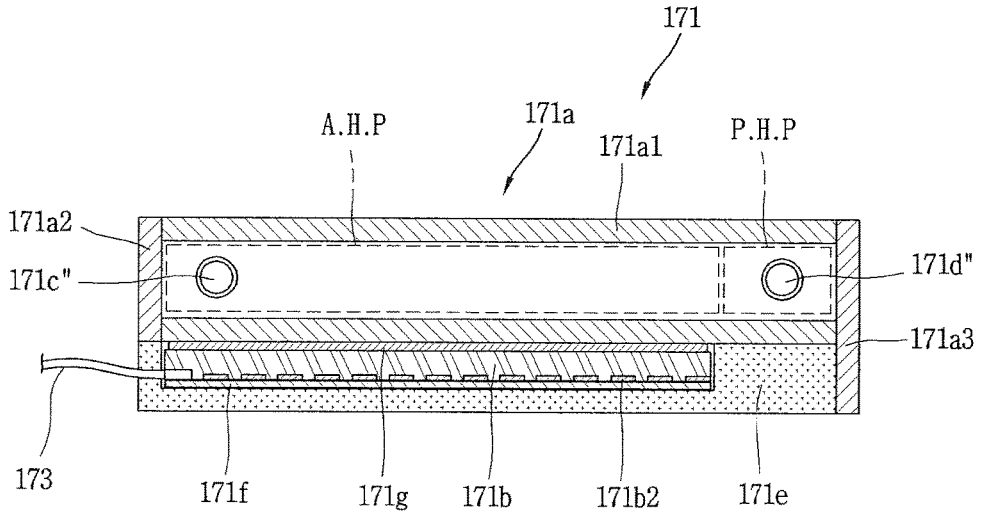
FIG. 5 is a cross-sectional view in which the heating unit illustrated in FIG. 4 is taken along a length direction.
Figure 6:
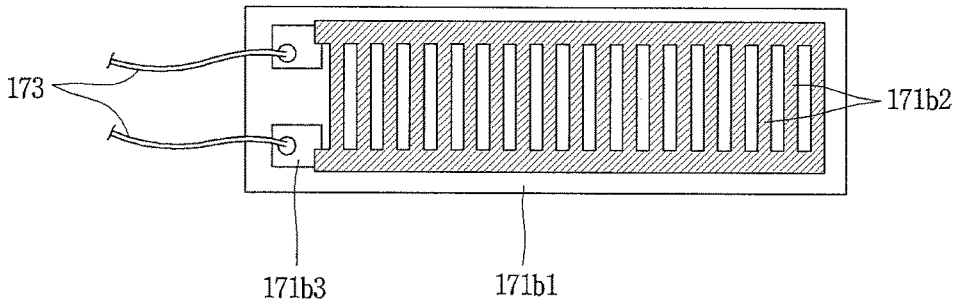
FIG. 6 is a conceptual view illustrating the heater illustrated in FIG. 4.

FIG. 4 is an exploded perspective view illustrating an example of the heating unit 171 illustrated in FIG. 3, and FIG. 5 is a cross-sectional view in which the heating unit 171 illustrated in FIG. 4 is taken along a length direction, and FIG. 6 is a conceptual view illustrating the heater **171*b* illustrated in FIG. 4**.

Referring to the present drawings along with the foregoing drawings, the heating unit 171 may include a heater case **171*a* and a heater 171*b***.

The heater case **171*a* has a hollow shape therein, and is connected to both end portions of the heat pipe 172, respectively, to form a closed loop shaped passage through which working fluid (F) can circulate along with the heat pipe 172. The heater case 171*a*** may have a rectangular pillar shape, and formed of an aluminum material.

The heater case **171*a* may be disposed at one side of the evaporator 130 at which the accumulator 134** is located, the other side opposite the one side, or at any point between the one side and the other side.

The heater case **171*a* may be disposed adjacent to the lowest column of the cooling tube 131. For example, the heater case 171*a* may be disposed at the same height as the lowest column of the cooling tube 131 or disposed at a position lower than the lowest column of the cooling tube 131**.

According to the present embodiment, it is shown that the heater case **171*a* is disposed in a horizontal direction of the evaporator 130 in parallel to the cooling tube 131 at a position lower than the lowest column of the cooling tube 131 at one side of the evaporator 130 at which the accumulator 134** is located.

The outlet **171*c*', 171*c*" and the inlet 171*d*', 171*d*" connected to both end portions of the heat pipe 172, respectively, are formed at both sides of the heater case 171*a***, respectively, in a length direction.

Specifically, the outlet **171*c*', 171*c*" communicated with one end portion of the heat pipe 172 is formed at one side of the heater case 171*a* (for example, an outer circumferential surface adjacent to a front end portion of the heater case 171*a*). The outlet 171*c*', 171*c*" denotes an opening through which working fluid (F) heated by the heater 171*b* is discharged to the heat pipe 172**.

The inlet **171*d*', 171*d*" communicated with the other end portion of the heat pipe 172 is formed at the other side of the heater case 171*a* (for example, an outer circumferential surface adjacent to a rear end portion of the heater case 171*a*). The inlet 171*d*', 171*d*" denotes an opening through which condensed working fluid (F) is collected to the heater case 171*a* while passing through the heat pipe 172**.

The heater **171*b* is attached to an outer surface of the heater case 171*a*, and configured to generate heat upon receiving a drive signal from the controller. Working fluid (F) within the heater case 171*a* receives heat due to the heater 171*b*** to be heated at high temperatures.

The heater **171*b* is extended and formed along one direction, and has a shape of being attached to an outer surface of the heater case 171*a* and extended along a length direction of the heater case 171*a*. A plate-shaped heater (for example, a plate-shaped ceramic heater) having a plate shape is used for the heater 171***b*.

According the present embodiment, the heater case 171*a* is formed in a rectangular pipe shape in which a vacant space therein has a rectangular cross-sectional shape, and it is shown that a plate-shaped heater 171*b* is attached to a bottom surface of the heater case 171*a*. In this manner, the structure in which the heater 171*b* is attached to a bottom surface of the heater case 171*a* may be beneficial in generating a driving force in an upward direction on the heated working fluid (F), and defrost water generated due to the defrost operation may not directly fall onto the heater 171*b*, thereby preventing a short circuit.

A hot wire 171*b*2 (refer to FIG. 6) is formed on the heater 171*b*, and configured to generate heat while supplying power. As illustrated in FIG. 6, the heater case 171*a* is divided into an active heating part (AHP) corresponding to a portion on which the hot wire 171*b*2 is disposed and a passive heating part (PHP) corresponding to a portion on which the hot wire 171*b*2 is not disposed. The active heating part (AHP) and passive heating part (PHP) will be described later.

The heat pipe 172 and heater case 171*a* may be formed of the same type material (for example, aluminum material), and in this case, the heat pipe 172 may be directly connected to the outlet 171*c*', 171*c*" and the inlet 171*d*', 171*d*" of the heater case 171*a*.

For reference, when the heater 171*b* is configured with a cartridge type and mounted within the heater case 171*a*, the heater case 171*a* with a copper material other than an aluminum material will be used to bond and seal between the heater 171*b* and the heater case 171*a*.

In this manner, when the heat pipe 172 and the heater case 171*a* are formed of different types of materials (as described above, when the heat pipe 172 is formed of an aluminum material, and the heater case 171*a* is formed of a copper material), it is difficult to directly connect the heat pipe 172 to the outlet 171*c*', 171*c*" and the inlet 171*d*', 171*d*" of the heater case 171*a*. Accordingly, for the connection between them, an outlet tube is extended and formed to the outlet 171*c*', 171*c*" of the heater case 171*a*, and a return tube is extended and formed to the inlet 171*d*', 171*d*" to connect the heat pipe 172 to the outlet tube and the return tube, and thus the bonding and sealing process is required for the procedure.

However, according to a structure in which the heater 171*b* is attached to an outer surface of the heater case 171*a*, the heater case 171*a* may be formed of the same material as that of the heat pipe 172, and the heat pipe 172 may be directly connected to the outlet 171*c*', 171*c*" and the inlet 171*d*', 171*d*" of the heater case 171*a*.

On the other hand, as working fluid (F) filled into the heater case 171*a* is heated to high temperatures by the heater 171*b*, the working fluid (F) flows due to a pressure difference to move the heat pipe 172. Specifically, the working fluid (F) at high temperatures heated by the heater 171*b* and discharged to the outlet 171*c*', 171*c*" transfers heat to the cooling tube 131 of the evaporator 130 while moving through the heat pipe 172. The working fluid (F) is gradually cooled while passing through the heat exchange process and introduced into the inlet 171*d*', 171*d*". The cooled working fluid (F) is reheated by the heater 171*b* and then discharged to the outlet 171*c*', 171*c*" again to repeatedly perform the foregoing processes. The defrosting of the cooling tube 131 is carried out due to such a circulation method.

Referring to FIGS. 2 and 3, at least part of the heat pipe 172 is disposed adjacent to the cooling tube 131 of the evaporator 130, and configured to transfer heat to the cooling tube 131 of the evaporator 130 due to high-temperature working fluid (F) heated and transferred by the heating unit 171 to remove frost.

The heat pipe 172 may have a shape of being repeatedly bent (a zigzag shape) similarly to the cooling tube 131. To this end, the heat pipe 172 may include an extension portion 172*a* and a heat emitting part 172*b*.

The extension portion 172*a* faults a passage for transferring working fluid (F) heated by the heating unit 171 in an upward direction of the evaporator 130. The extension portion 172*a* is connected to an outlet 171*c*', 171*c*" of the heater case 171*a* provided below the evaporator 130 and the heat emitting part 172*b* provided on the evaporator 130.

The extension portion 172*a* may include a vertical extension portion extended in an upward direction of the evaporator 130. The vertical extension portion is extended up to an upper portion of the evaporator 130 in the state of being disposed to be separated from the support fixture 133 at an outer side of the support fixture 133 provided at one side of the evaporator 130.

On the other hand, the extension portion 172*a* may further include a horizontal extension portion according to the installation position of the heating unit 171. For an example, when the heating unit 171 is provided at a position separated from the vertical extension portion (refer to FIG. 20), a horizontal extension portion for connecting the heating unit 171 to the vertical extension portion may be additionally provided.

When the horizontal extension portion is connected to the heating unit 171 and extended in an elongated manner, high-temperature working fluid (F) may pass through a lower portion of the evaporator 130, thereby having an advantage of efficiently implementing a defrost operation on the cooling tube 131 at a lower side of the evaporator 130.

The heat emitting part 172*b* is connected to the extension portion 172*a* extended to an upper portion of the evaporator 130, and extended in a zigzag shape along the cooling tube 131 of the evaporator 130. The heat emitting part 172*b* is configured in combination with a plurality of horizontal tubes 172*b*' constituting columns and a connecting tube 172*b*" formed in a bent U-shaped tube to connect them in a zigzag shape.

The extension portion 172*a* or heat emitting part 172*b* may be extended up to a position adjacent to an accumulator 134 to remove frost formed on the accumulator 134.

As illustrated in the drawing, when the vertical extension portion is disposed at one side of the evaporator 130 at which the accumulator 134 is located, the vertical extension portion may be extended upward to a position adjacent to the accumulator 134, and then bent and extended downward toward the cooling tube 131 to be connected to the heat emitting part 172*b*.

On the contrary, when the vertical extension portion is disposed at the other side opposite to the one side, the heat emitting part 172*b* may be connected to the vertical extension portion and extended in a horizontal direction, and then extended upward toward the accumulator 134, and then extended downward again to correspond to the cooling tube 131.

For the heat pipe 172, a portion connected to the outlet 171*c*', 171*c*" of the heater case 171*a* constitutes an entrance portion 172*c*', 172*c*" for introducing high-temperature working fluid (F), and a portion connected to the inlet 171*d*', 171*d*" of the heater case 171*a* constitutes a return portion 172*d*', 172*d*" for returning the cooled working fluid (F).

According to the present embodiment, working fluid (F) heated by the heater 171*b* forms a circulation loop in which the working fluid (F) is discharged to the entrance portion 172*c*', 172*c*" and transferred to an upper portion of the evaporator 130 through the extension portion 172*a*, and then heat is transferred to the cooling tube 131 while flowing along the heat emitting part 172*b* to perform a defrost operation, and then the working fluid (F) is returned through the return portion 172*d*', 172*d*", and reheated by the heater 171*b* again to flow the heat pipe 172.

According to a structure in which the heat pipe 172 is configured with the first and the second heat pipe 172', 172", the first and the second heat pipe 172', 172" are connected to the inlet 171*d*', 171*d*" and the outlet 171*c*', 171*c*" of the heating unit 171, respectively.

Specifically, the outlet 171*c*', 171*c*" of the heating unit 171 is configured with a first outlet 171*c*' and a second outlet 171*c*", and one end portion of the first and the second heat pipe 172', 172", respectively, is connected to the first and the second outlet 171*c*', 171*c*", respectively. Due to the foregoing connection structure, working fluid (F) in the gas phase heated by the heating unit 171 is discharged to the first and the second heat pipe 172', 172", respectively, through the first and the second outlet 171*c*', 171*c*".

The first and the second outlet 171*c*', 171*c*" may be formed at both sides of an outer circumference of the heater case 171*a*, respectively, and formed in parallel at a front portion of the heater case 171*a*.

It may be understood that one end portion of the first and the second heat pipe 172', 172" connected to the first and the second outlet 171*c*', 171*c*", respectively, is the first and the second entrance portions 172*c*', 172*c*" (a portion to which working fluid (F) at high temperatures heated by the heater 171*b* is introduced) due to the function.

Furthermore, the inlet 171*d*', 171*d*" of the heating unit 171 is configured with a first inlet 171*d*' and a second inlet 171*d*", and the other end of the first and the second heat pipe 172', 172", respectively, is connected to the inlet 171*d*', 171*d*", respectively. Due to the connection structure, working fluid (F) in the liquid phase cooled while moving the heat pipes 172, respectively, is introduced into the heater case 171*a* through the first and the second inlet 171*d*', 171*d*".

The first and the second inlet 171*d*', 171*d*" may be formed at both sides of an outer circumference of the heater case 171*a*, respectively, and Ruined in parallel at a rear portion of the heater case 171*a*.

It may be understood that the other end portion of the first and the second heat pipe 172', 172" connected to the inlet 171*d*', 171*d*", respectively, is the first and the second return portions 172*d*', 172*d*" (a portion to which working fluid (F) in the liquid phase cooled while moving through the heat pipes 172, respectively, is collected) due to the function.

On the other hand, referring to FIGS. 4 and 5, the outlet 171*c*', 171*c*" of the heater case 171*a* may be formed at a position separated by a predetermined distance from a front end of the heater case 171*a* in a backward direction. In other words, it may be understood that the front end portion of the heater case 171*a* is protruded and formed in a forward direction from the outlet 171*c*', 171*c*".

The hot wire 171*b*2 of the heater 171*b* may be extended and formed from one point between the inlet 171*d*', 171*d*" and the outlet 171*c*', 171*c*" to a position passed through the outlet 171*c*', 171*c*". According to this, the outlet 171*c*', 171*c*" of the heater case 171*a* is located within the active heating part (AHP).

Due to the foregoing structure, part of working fluid (F) stays at a front end portion (a space between an inner front end and the outlet 171*c*', 171*c*" of the heater case 171*a*) to prevent the overheating of the heater 171*b*.

Specifically, working fluid (F) heated by the active heating part (AHP) moves in a direction through which the working fluid (F) circulates, namely, toward a front end portion of the heater case 171*a*, and during this process, part of the working fluid (F) is discharged to the branched outlet 171*c*', 171*c*", but the remaining working fluid passes through the outlet 171*c*', 171*c*" and stays while forming a vortex at a front end portion of the heater case 171*a*.

In this manner, the whole of the heated working fluid (F) is not immediately discharged to the outlet 171*c*', 171*c*", but part thereof stays within the heater case 171*a* without being immediately discharged to the outlet 171*c*', 171*c*", thereby further preventing the overheating of the heater 171*b*.

On the other hand, the heat pipe 172 may be accommodated between a plurality of cooling fins 132 fixed to each column of the cooling tube 131. According to the foregoing structure, the heat pipe 172 is disposed between each column of the cooling tube 131. Here, the heat pipe 172 may be configured to make contact with the cooling fin 132.

However, the present disclosure may not be necessarily limited to this. For an example, the heat pipe 172 may be provided to pass through a plurality of cooling fins 132. In other words, the heat pipe 172 may be flared in the state of being inserted into an insertion hole of the cooling fin 132, and securely inserted into the insertion hole. According to the foregoing structure, the heat pipe 172 is disposed to correspond to the cooling tube 131.

As described above, the heater 171*b* applied to the heating unit 171 of the present disclosure may be formed in a plate shape, and a plate-shaped ceramic heater 171*b* may be typically used.

As illustrated in FIG. 6, the heater 171*b* may include a base plate 171*b*1, a hot wire 171*b*2 and a terminal 171*b*3.

The base plate 171*b*1 is formed of a ceramic material, and formed in a plate shape extended in an elongated manner along one direction. The base plate 171*b*1 is attached to an outer surface of the heater case 171*a*, and disposed along a length direction of the heater case 171*a*.

The hot wire 171*b*2 is formed on the base plate 171*b*1, and the hot wire 171*b*2 is configured to emit heat during the application of power. In a state that the base plate 171*b*1 is attached to an outer surface of the heater case 171*a*, the hot wire 171*b*2 has a shape of being extended from one point between the inlet 171*d*', 171*d*" and the outlet 171*c*', 171*c*" toward the outlet 171*c*', 171*c*".

The hot wire 171*b*2 may be formed by patterning a resistor *for example, powder mixed with ruthenium and platinum, tungsten, etc.) on the base plate 171*b*1 with a specific pattern. The hot wire 171*b*2 may be extended and formed along a length direction of the base plate 171*b*1.

A terminal 171*b*3 configured to electrically connect the hot wire 171*b*2 to power is provided at one side of the base plate 171*b*1, and a lead wire 173 electrically connected to the power is connected to the terminal 171*b*3.

On the other hand, the heater case 171*a* is divided into an active heating part (AHP) corresponding to a portion on which the hot wire 171*b*2 is disposed and a passive heating part (PHP) corresponding to a portion on which the hot wire 171*b*2 is not disposed.

The active heating part (AHP) is a portion directly heated by the hot wire 171*b*2, and working fluid (F) at the liquid phase is heated by the active heating part (AHP) and phase-changed into the gas phase at high temperatures.

The outlet 171*c*', 171*c*" of the heater case 171*a* may be located within the active heating part (AHP) or located at a front side than the active heating part (AHP). In FIG. 6, it is illustrated that a portion formed with the hot wire 171*b*2 of the heater 171*b* is extended and formed in a forward direction through a lower portion of the outlet 171*c*', 171*c*" formed on an outer circumference of the heater case 171*a*. In other words, according to the present embodiment, the outlet 171*c*', 171*c*" of the heater case 171*a* is located within the active heating part (AHP).

The passive heating part (PHP) is formed at a rear side of the active heating part (AHP). The passive heating part (PHP) indirectly receives heat to be heated to a predetermined temperature level though it is not a portion directly heated by the hot wire 171*b*2 like the active heating part (AHP). Here, the passive heating part causes a predetermined temperature increase to the working fluid (F) in the liquid phase, but does not have high temperatures to the extent of phase-changing the working fluid (F) to the gas phase. In other words, in the aspect of temperature, the active heating part (AHP) forms a relatively high-temperature portion and the passive heating part forms a relatively low-temperature portion.

If working fluid (F) is configured to directly return to a side of the active heating part (AHP) at high temperatures, then it may occur a case where the collected working fluid (F) is reheated and flowed backward without being efficiently returned into the heater case 171*a*. It may be an obstacle to the circulation flow of the working fluid (F) within the heat pipe 172, thereby causing a problem of overheating the heater 171*b*.

In order to solve the foregoing problem, it is configured such that the inlet 171*d*', 171*d*" of the heating unit 171 is formed to correspond to the passive heating part (PHP) not to allow working fluid (F) that has moved through the heat pipe 172 and then returned to be immediately introduced into the active heating part (AHP).

According to the present embodiment, it is configured that the inlet 171*d*', 171*d*" of the heating unit 171 is located within the passive heating part (PHP) to allow working fluid (F) that has moved through the heat pipe 172 and then returned to be introduced into the passive heating part (PHP). In other words, the inlet 171*d*', 171*d*" of the heating unit 171 is formed at a portion on which the hot wire 171*b*2 is not disposed on the heater case 171*a*.

As described above, the passive heating part (PHP) is associated with the formation location of the hot wire 171*b*2. Accordingly, if the hot wire 171*b*2 is not extended and formed up to the inlet 171*d*', 171*d*" of the heating unit 171, then the base plate 171*b*1 of the heater 171*b* may be extended and formed up to a portion corresponding to the inlet 171*d*', 171*d*". In other words, the base plate 171*b*1 may be disposed to cover the most bottom surface of the heater case 171*a*, and the hot wire 171*b*2 may be formed at a position out of the inlet 171*d*', 171*d*", thereby preventing working fluid (F) returned through the inlet 171*d*', 171*d*" from flowing backward.

Hereinafter, the detailed structure of the heater case 171*a* and the coupling structure between the heater case 171*a* and the heater 171*b* will be described in more detail.

The heater case 171*a* may include a main case 171*a*1, a first cover 171*a*2 and a second cover 171*a*3 coupled to both sides of the main case 171*a*1, respectively.

The main case 171*a*1 is provided with a vacant space therein, and has a shape in which both end portions thereof are open. The main case 171*a*1 may be formed of an aluminum material. In FIG. 5, it is illustrated the main case 171*a*1 in a rectangular pillar shape in which a vacant space therein having a rectangular cross-sectional shape is extended and formed in an elongated manner along one direction.

The first and the second cover 171*a*2, 171*a*3 are mounted at both sides of the main case 171*a*1 to cover both end portions of the main case 171*a*1 that are open. The first and the second cover 171*a*2, 171*a*3 may be formed of an aluminum material like the main case 171*a*1.

According to the present embodiment, it is shown a structure in which the outlet 171*c*', 171*c*" and the inlet 171*d*', 171*d*" are provided at positions separated from each other along a length direction of the main case 171*a*1, respectively, and the both end portions (the entrance portion 172*c*', 172*c*" connected to the outlet 171*c*', 171*c*" and the return portion 172*d*', 172*d*" connected to the inlet 171*d*', 171*d*") of the heat pipe 172 are connected to the outlet 171*c*', 171*c*" and the inlet 171*d*', 171*d*".

More specifically, the first outlet 171*c*' and the first inlet 171*d*' are formed at positions separated from each other along a length direction on one lateral surface of the main case 171*a*1, and the second outlet 171*c*" and the second inlet 171*d*" are formed at positions separated from each other along a length direction on the other lateral surface facing the one surface. Here, the first outlet 171*c*' and the second outlet 171*c*" may be disposed to face each other, and the first inlet 171*d*' and the second inlet 171*d*" may be disposed to face each other.

However, the present disclosure may not be necessarily limited to this. At least one of the inlet 171*d*', 171*d*" and the outlet 171*c*', 171*c*" may be formed on a first and/or a second cover 171*a*2, 171*a*3. A structure associated therewith will be described in more detail later.

On the other hand, the heating unit 171 is provided below the evaporator 130, and thus defrost water generated due to defrosting in the aspect of the structure may flow down to the heating unit 171. The heater 171*b* provided in the heating unit 171 is an electronic component, and thus when defrost water is brought into contact with the heater 171*b*, it may cause a short circuit. As described above, the heating unit 171 of the present disclosure may include the following sealing structure to prevent moisture including defrost water from infiltrating into the heater 171*b*.

First, the heater 171*b* is attached to a bottom surface of the main case 171*a*1, and a first and a second extension pin 171*a*1*a*, 171*a*1*b* extended and formed in a downward direction from the bottom surface to cover a lateral surface of the heater 171*b* attached to the bottom surface are configured at both sides of the main case 171*a*1. Due to the structure, even when defrost water generated due to defrosting falls onto the main case 171*a*1 and flows down along an outer surface of the main case 171*a*1, the defrost water does not infiltrate into the heater 171*b* accommodated at an inner side of the first and the second extension pin 171*a*1*a*, 171*a*1*b*.

Furthermore, a sealing member 171*e* may be filled into a recessed space 171*a*1' formed by a rear surface of the heater 171*b* and the first and the second extension pin 171*a*1*a*, 171*a*1*b* as described above. Silicon, urethane, epoxy or the like may be used for the sealing member 171*e*. For example, epoxy in the liquid phase may be filled into the recessed space 171*a*1' and then subject to the curing process to complete the sealing structure of the heater 171*b*. Here, the first and the second extension pin 171*a*1*a*, 171*a*1*b* may function as a sidewall limiting the recessed space 171*a*1' into which the sealing member 171*e* is filled.

An insulating material 171*f* may be interposed between a rear surface of the heater 171*b* and the sealing member 171*e*. A mica sheet with a mica material may be used for the insulating material 171*f*. The insulating material 171*f* may be disposed on a rear surface of the heater 171*b*, thereby limiting heat from being transferred to a side of the rear surface of the heater 171*b* when the hot wire 171*b*2 emits heat according to the application of power.

Moreover, a thermally conductive adhesive 171*g* may be interposed between the main case 171*a*1 and the heater 171*b*. The thermally conductive adhesive 171*g* may attach the heater 171*b* to the main case 171*a*1 to perform the role of transferring heat generated from the heater 171*b* to the main case 171*a*1. A heat-resistant silicone capable of enduring high temperatures may be used for the thermally conductive adhesive 171*g*.

On the other hand, at least one of the first and the second cover 171*a*2, 171*a*3 may be extended and formed from the bottom of the main case 171*a*1 in a downward direction to surround the heater 171*b* along with the first and the second extension pin 171*a*1*a*, 171*a*1*b*. Due to the structure, the filling of the sealing member 171*e* may be more easily carried out.

However, considering a structure in which the lead wire 173 connected to the terminal 171*b*3 of the heater 171*b* is extended from one side of the heater case 171*a* to an outside, a cover corresponding to one side of the heater case 171*a* on the first and the second cover 171*a*2, 171*a*3 may not be extended and formed in a downward direction or may be provided with a groove or hole allowing the lead wire 173 to pass therethrough even when extended and formed in a downward direction.

According to the present embodiment, it is shown that the second cover 171*a*3 is extended and formed from the bottom surface of the main case 171*a*1 in a downward direction, and the lead wire 173 is extended and formed to a side of the first cover 171*a*2.

Figure 7:
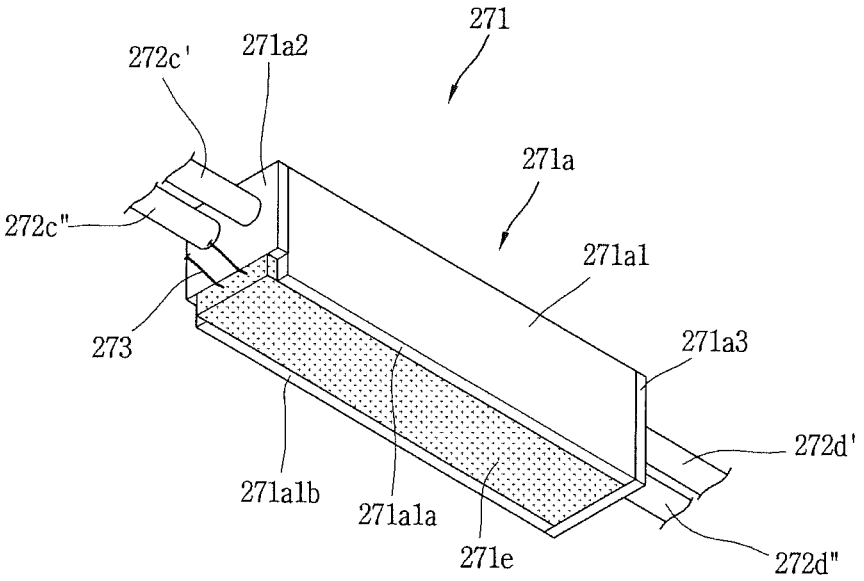
FIGS. 7 through 9 are exploded perspective views illustrating examples in which the formation positions of an outlet and an inlet are modified in the heating unit illustrated in FIG. 4
Figure 8:
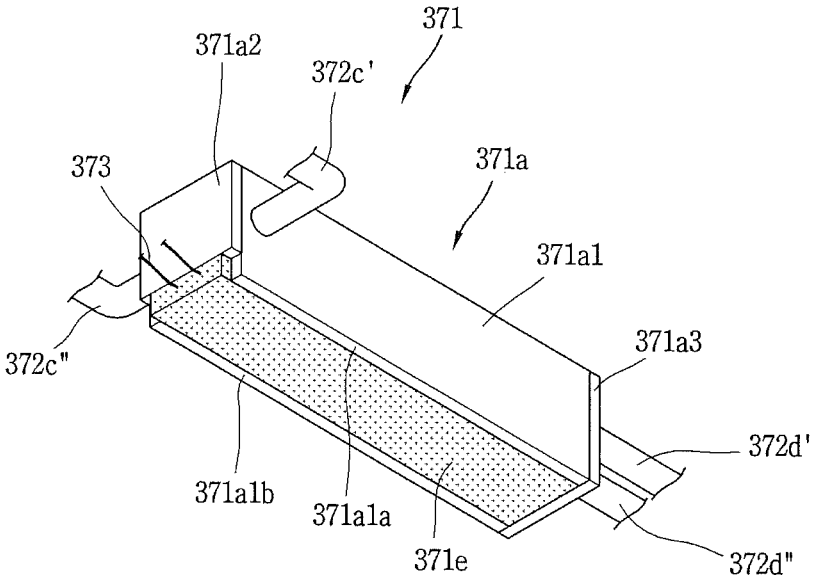
Figure 9:
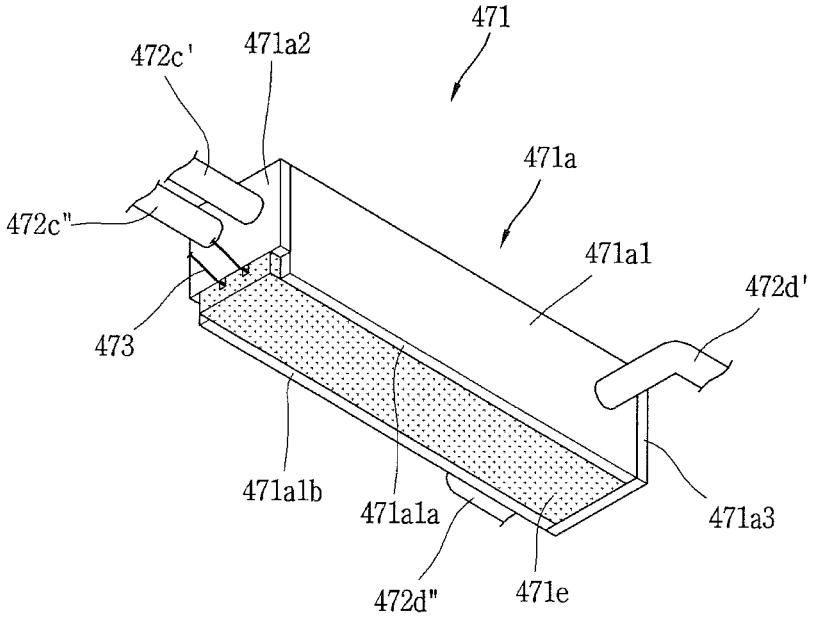

FIGS. 7 through 9 are exploded perspective views illustrating examples in which the formation positions of an outlet 171*c*', 171*c*" and an inlet 171*d*', 171*d*" are modified in the heating unit 171 illustrated in FIG. 4. The modified example is merely different from the foregoing embodiment in only the formation positions of the outlet 171*c*', 171*c*" and/or inlet 171*d*', 171*d*", and the configurations of the foregoing embodiment may be applied in a similar manner to other configurations.

First, referring to FIG. 7, an inlet and an outlet of a heating unit 271 may be formed on a first and a second cover 271*a*2, 271*a*3, respectively. Specifically, a first and a second outlet of the heating unit 271 may be formed together on the first cover 271*a*2, and a first and a second entrance portion 272*c*', 272*c*" connected to the first and the second outlet, respectively, may be disposed in parallel. Furthermore, the first and the second inlet of the heating unit 271 may be formed together on the second cover 271*a*3, and a first and a second return portion 272*d*', 272*d*" connected to the first and the second inlet, respectively, may be disposed in parallel.

As described above, the outlet and inlet of the heating unit 271 may be formed on both lateral surfaces of a main case 271*a*1, and formed on the first and the second cover 271*a*2, 271*a*3. In addition, a combination of the foregoing structures is also possible.

For an example, as illustrated in FIG. 8, an outlet of a heating unit 371 may be formed on a main case 371*a*1, and an inlet of the heating unit 371 may be formed on a second cover 371*a*1. Specifically, a first and a second outlet of the heating unit 371 may be formed on both lateral surfaces of the main case 371*a*1 to face each other. Furthermore, a first and a second inlet of the heating unit 371 may be formed together, and a first and a second return portion 372*d*', 372*d*" connected to the first and the second inlet, respectively, may be disposed in parallel.

For another example, as illustrated in FIG. 9, an outlet of a heating unit 471 may be formed on a main case 471*a*1. Specifically, a first and a second inlet of the heating unit 471 may be formed together on a second cover 471*a*3, and a first and a second entrance portion 472*c*', 472" connected to the first and the second outlet, respectively, may be disposed in parallel. Furthermore, a first and a second outlet of the heating unit 471 may be formed on both lateral surfaces of the main case 471*a*1 to face each other.

Figure 10:
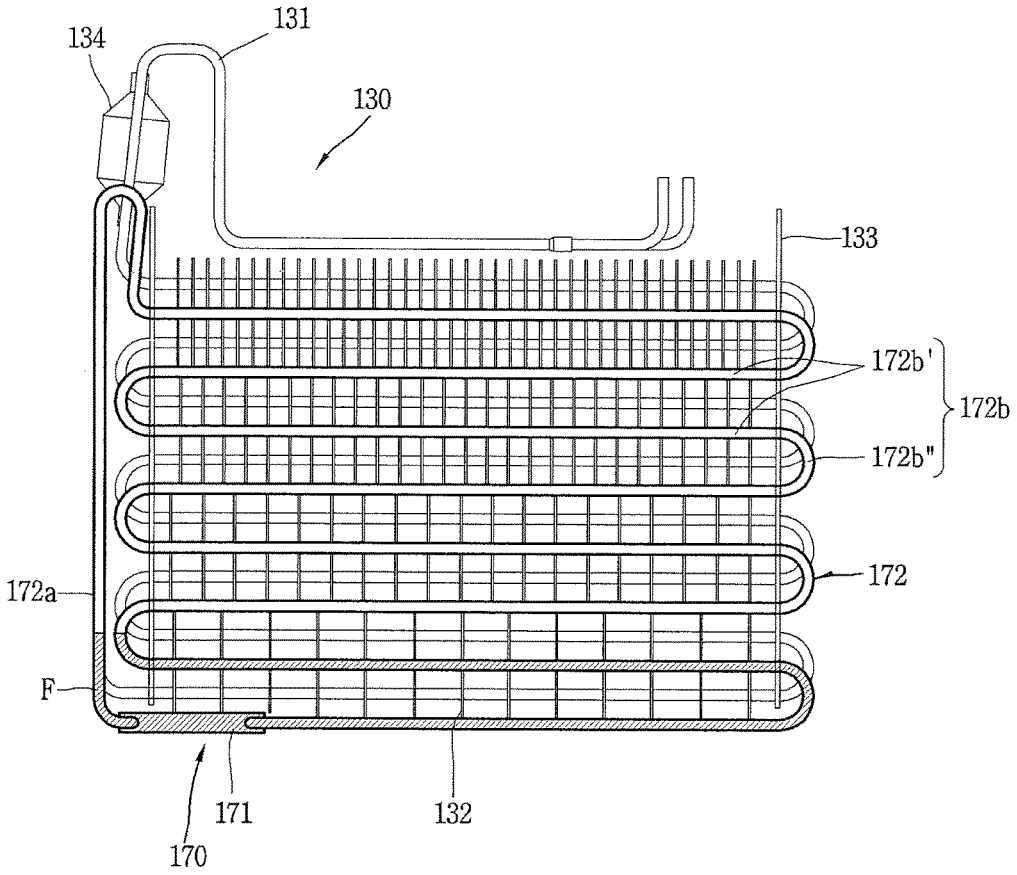
FIGS. 10 and 11 are conceptual views for explaining the circulation of working fluid in a state prior to or subsequent to the operation of the heater
Figure 11:
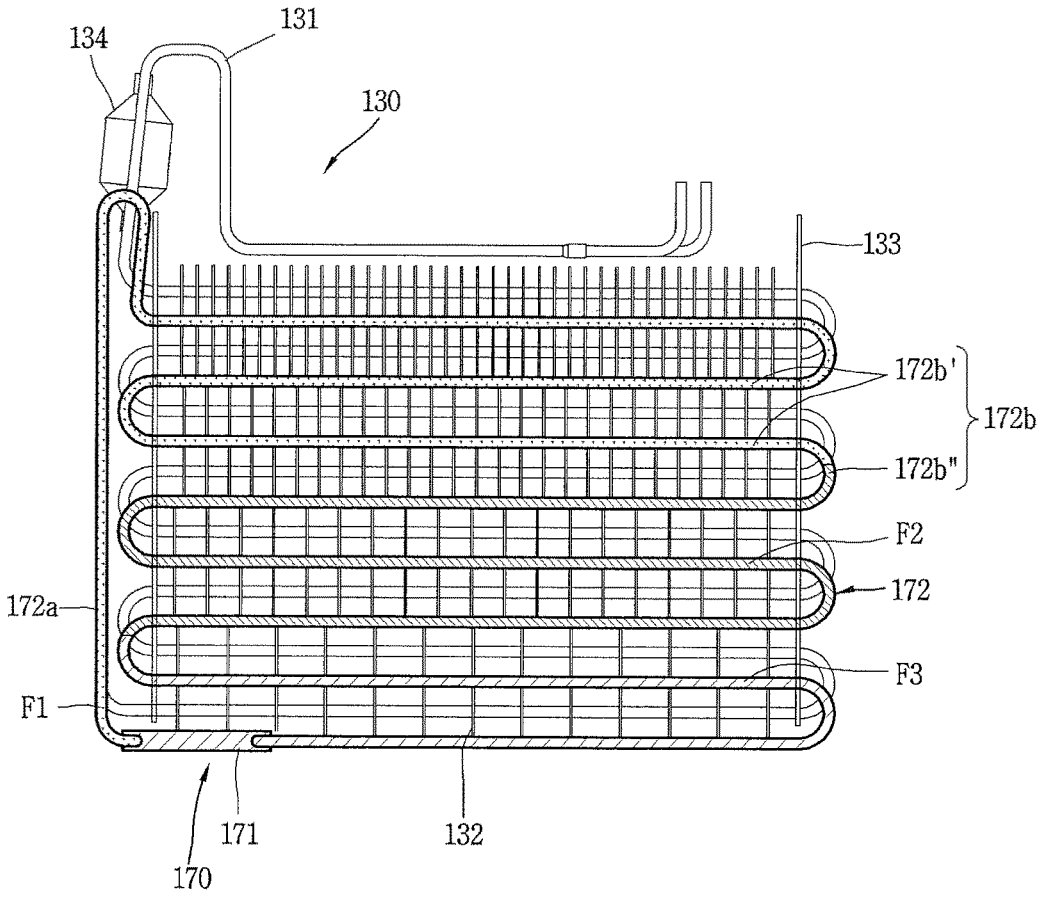

FIGS. 10 and 11 are conceptual views for explaining the circulation of working fluid (F) in a state prior to or subsequent to the operation of the heater 171*b*.

First, referring to FIG. 10, prior to the operation of the heater 171*b*, working fluid (F) is present in a liquid phase, and filled up to a preset column of the top based on the lowest column of the heat pipe 172. For an example, the working fluid (F) in this state may be filled up to the lower two columns of the heat pipe 172.

When the heater 171*b* is operated, working fluid (F) within the heater case 171*a* is heated by the heater 171*b*. Referring to FIG. 11, working fluid heated in a high-temperature gas phase (F1) is introduced into the entrance portion 172*c*', 172*c*" of the heat pipe 172 to dissipate heat to the cooling tube 131 while flowing through the heat pipe 172. The working fluid (F) flows in a phase (F2) that liquid and gas coexist while losing heat during the heat dissipation process, and is finally introduced into the heating unit 171 through the return portion 172*d*', 172*d*" of the heat pipe 172 in a liquid phase (F3). The working fluid (F) introduced into the heating unit 171 is heated again by the heater 171*b* to repeat (circulate) the foregoing flow, and transfer heat to the evaporator 130 during the process, thereby removing frost formed on the evaporator 130.

As described above, working fluid (F) flows by a pressure difference generated by the heating unit 171 to quickly circulate the heat pipe 172, and thus the entire section of the heat pipe 172 may reach a stable operating temperature within a short period of time, thereby quickly carrying out defrosting.

On the other hand, working fluid (F) introduced into the entrance portion 172*c*', 172*c*" is in a high-temperature gas phase (F1) and has the highest temperature during the circulation process of the heat pipe 172. Accordingly, the convection of heat due to working fluid (F) in such a high-temperature gas phase (F1) may be used to more efficiently remove frost formed on the evaporator 130.

For an example, the entrance portion 172*c*', 172*c*" may be disposed at a relatively lower position than that of the lowest column of the cooling tube 131 provided in the evaporator 130 or at the same position as that of the lowest column. Accordingly, high-temperature working fluid (F) introduced through the entrance portion 172*c*', 172*c*" may transfer heat in the vicinity of the lowest column of the cooling tube 131 as well as such heat is increased and transferred to the cooling tube 131 adjacent to the lowest column.

On the other hand, in order to allow working fluid (F) to circulate the heat pipe 172 while carrying out such a phase change, an appropriate amount of the working fluid (F) should be filled into the heat pipe 172.

As a result of experiment, it is seen that the temperature of the heating unit 171 rapidly increases according to the passage of time when working fluid (F) less than 30% compared to the entire internal volume of the heat pipe 172 and heater case 171*a* is filled. It denotes that working fluid (F) is insufficient compared to the entire internal volume of the heat pipe 172 and heater case 171*a*.

Furthermore, it is seen that the temperature of partial heat of the heat pipe 172 does not reach a stable operating temperature (less than 50° (freezing condition)) when working fluid (F) greater than 40% compared to the entire internal volume of the heat pipe 172 and heater case 171*a* is filled. Such a temperature decrease will be apparent as the heat pipe 172 is located closer to the return portion 172*d*', 172*d*". It denotes that working fluid (F) compared to the entire internal volume of the heat pipe 172 and heater case 171*a* is excessive to increase a section in which working fluid (F) flows in a liquid phase.

It is seen that the temperature of the heating unit 171 and the temperature of each column of the heat pipe 172 reaches a stable operating temperature according to the passage of time when working fluid (F) greater than 30% but less than 40% compared to the entire internal volume of the heat pipe 172 and heater case 171*a* is filled.

Here, it is shown that the temperature of each column of the heat pipe 172 exhibits higher temperature as closer to the entrance portion 172*c*', 172*c*", and exhibits lower temperature as closer to the return portion 172*d*', 172*d*". As an amount of filled working fluid (F) decreases, a difference between the temperature (maximum temperature) on the entrance portion 172*c*', 172*c*" and the temperature (minimum temperature) on the return portion 172*d*', 172*d*" decreases.

Accordingly, working fluid (F) greater than 30% but less than 40% compared to the entire internal volume of the heat pipe 172 and heater case 171*a* may be filled, but an optimized filling amount of working fluid (F) may be chosen for each defrosting device 170.

On the other hand, according to the structure in which the heater 171*b* is attached to an outer surface of the heater case 171*a*, a structure of enhancing the heat transfer performance of the heater 171*b* to the heater case 171*a* as well as preventing the overheating of the heater 171*b* may preferably taken into consideration. Hereinafter, the heating unit 171 in consideration of such items will be described.

Figure 12:
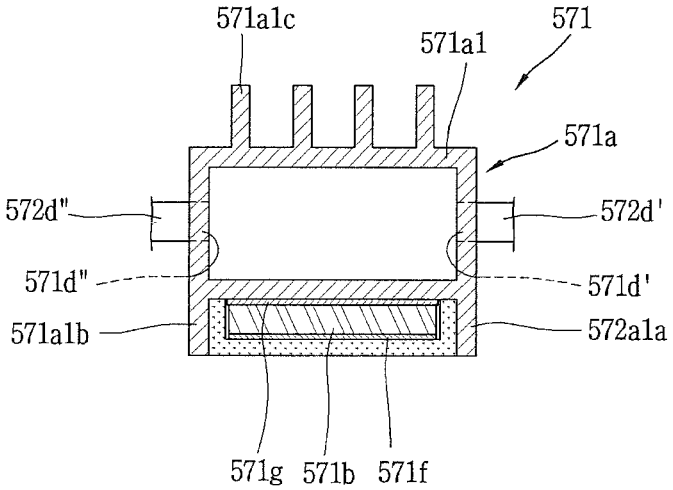
FIG. 12 is a cross-sectional view in which another example of the heating unit illustrated in FIG. 3 is taken along a width direction

FIG. 12 is a cross-sectional view in which another example 571 of the heating unit 171 illustrated in FIG. 3 is taken along a width direction.

Referring to FIG. 12, an outer fin 571*a*1*c* for the heat dissipation of the heater case is protruded and formed on an outer surface of the heater case. The outer fin 571*a*1*c* may be integrally formed on the heater case as a protruded configuration during the fabrication of the heater case (for example, extrusion molding of aluminum) or attached to the heater case by welding, an adhesive or the like as an additional configuration.

When the outer fin 571*a*1*c* is formed on an outer surface of the heater case as described above, an outer area of the heater case increases compared to a structure in which the outer fin 571*a*1*c* is not formed. As a result, it may be possible to enhance heat exchange efficiency between ambient low-temperature air and the heater case.

According to the foregoing structure, a significant amount of heat generated from a heater 571*b* may be transferred to the heater case at a front side (in an upward direction of the present drawing) of the heater 571*b* [heat transfer to a rear side of the heater 571*b* relatively decreases), thereby preventing the overheating of the heater 571*b*. Furthermore, a rear temperature of the heater 571*b* is reduced to enhance the reliability and lifespan of the heater 571*b*. Moreover, heat transfer to a sealing member 571*e* provided at a rear side of the heater 571*b* decreases to prevent the melting of the sealing member 571*e*.

Hereinafter, the containment of the outer fin 571*a*1*c* will be described in more detail.

As illustrated in the drawing, the outer fin 571*a*1*c* may be formed on an upper surface of a main case 571*a*1. A plurality of outer fins 571*a*1*c* may be provided thereon, and extended and formed along a length or width direction of the main case 571*a*1 with a predetermined separation distance from each other. According to the present embodiment, it is seen that the outer fin 571*a*1*c* is extended and formed along a length direction of the main case 571*a*1.

A separation distance between the plurality of outer fins 571*a*1*c* may be formed to be the same as a width of the outer fin 571*a*1*c* or to be larger than the width of the outer fin 571*a*1*c*. It is because a heat dissipation effect due to the outer fin 571*a*1*c* is not so large compared to a structure in which the outer fin 571*a*1*c* is not formed when the separation distance between the plurality of outer fins 571*a*1*c* is smaller than the width of the outer fin 571*a*1*c*.

In a structure in which the heater 571*b* is attached to a bottom surface of the main case 571*a*1, a significant amount of heat generated from the heater 571*b* is transferred to the main case 571*a*1 at a front side of the heater 571*b* by the outer fin 571*a*1*c* formed at an upper portion of the main case 571*a*1. Due to such heat transfer, it may be possible to prevent the overheating of the heater 571*b* as well as transfer a larger amount of heat to working fluid (F) within the main case 571*a*1 during the heat transfer process. In other words, the enhancement of heat transfer efficiency is accomplished.

On the other hand, when working fluid (F) is all in a liquid phase, it is configured such that the working fluid (F) is completely filled into a vacant space within the main case 571*a*1 to transfer the maximum amount of heat to the working fluid (F). It may be satisfied as described above in case where the heater case is provided at a lower portion of the evaporator 130, and working fluid (F) greater than 30% but less than 40% compared to the entire internal volume of the heat pipe and heater case is filled.

Figure 13:
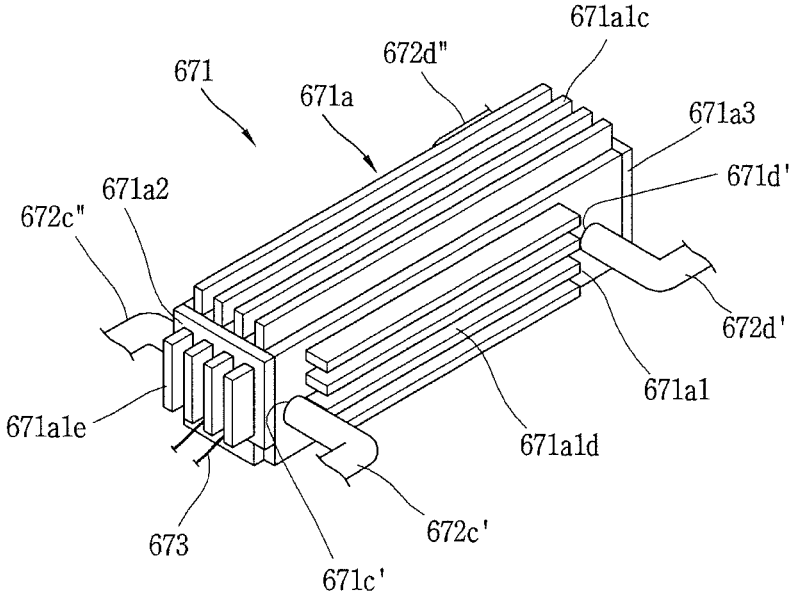
FIGS. 13 and 14 are conceptual views illustrating examples in which the shape of outer fins is modified in the heating unit illustrated in FIG. 12
Figure 14:
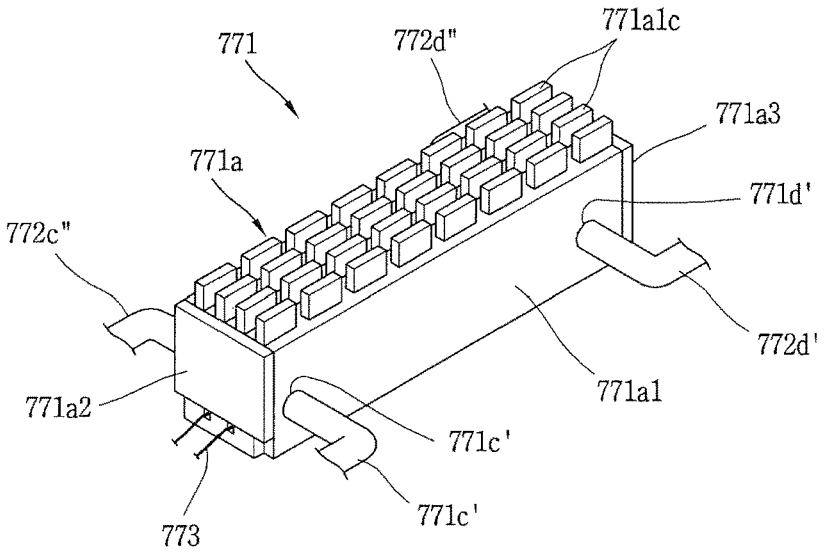

FIGS. 13 and 14 are conceptual views illustrating examples in which the shape of outer fins 571*a*1*c* is modified in the heating unit 571 illustrated in FIG. 12.

First, referring to FIG. 13, an outer fin 671*a*1*c* may be formed on an upper surface of a main case 671*a*1 as well as another outer surface thereof.

For an example, the outer fin 671*a*1*c* may be protruded and formed on both outer surfaces of the main case 671*a*1, respectively. However, when an outlet 671*c*', 671*c*" and an inlet 671*d*', 671*d*" of a heating unit 671 are formed on both lateral surfaces of the main case 671*a*1, the outer fin 671*a*1*c* may be formed in an elongated manner between the outlet 671*c*', 671*c*" and the inlet 671*d*', 671*d*".

For another example, the outer fin 671*a*1*c* may be also protruded and formed on an outer surface of at least one of a first and a second cover 671*a*2, 671*a*3. However, when the outer fin 671*a*1*c* is formed on a cover corresponding to one of the outlet 671*c*', 671*c*" and inlet 671*d*', 671*d*" of the heating unit 671, the outer fin 671*a*1*c* may be protruded and formed on an outer surface of at least one cover on which the outlet 671*c*', 671*c*" and inlet 671*d*', 671*d*" are not formed between the first and the second cover 671*a*2, 671*a*3.

Next, an outer fin 771*a*1*c* may be protruded and formed in a protrusion shape on an outer surface of a heater case 771*a*.

For an example, as illustrated in FIG. 14, a plurality of outer fins 771*a*1*c* are provided, and disposed along a length and a width direction of a main case 771*a*1 with a predetermined separation distance from each other. Accordingly, the plurality of outer fins 771*a*1*c* may be disposed to form a matrix.

For another example, a plurality of outer fins 771*a*1*c* are provided to have a protruded shape on an outer surface of the main case 771*a*1.

According to the foregoing structure, an outer area of the heater case due to outer fins may be further increased. As a result, it may be possible to further enhance heat exchange efficiency between ambient low-temperature air and the heater case, and further enhance the reliability and lifespan of the heater due to the overheating prevention of the heater.

On the other hand, in the aspect of a configuration in which the foregoing first and second extension fins are also protruded and formed on the heater case, they may be understood as a type of outer fins. Accordingly, the above-mentioned effect may be also accomplished by the first and the second extension fins.

Figure 15:
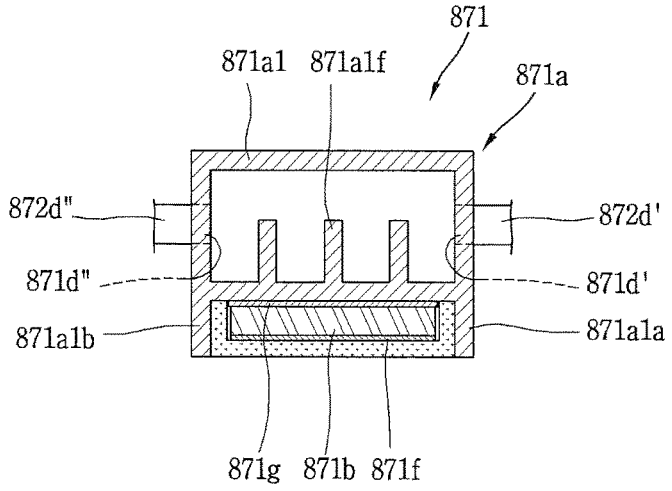
FIGS. 15 and 16 are cross-sectional views in which still another example of the heating unit illustrated in FIG. 3 is taken along a width and a length direction
Figure 16:
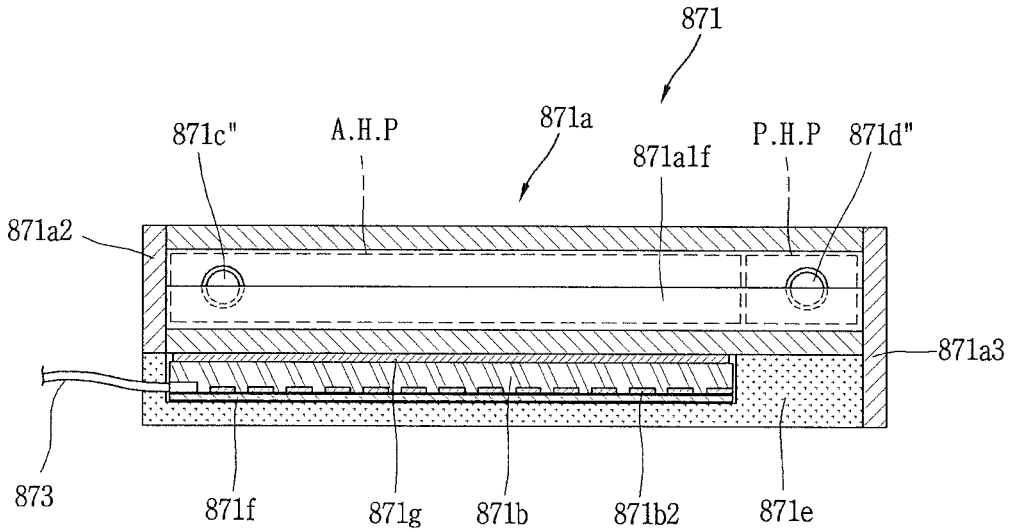

FIGS. 15 and 16 are cross-sectional views in which still another example 871 of the heating unit 171 illustrated in FIG. 3 is taken along a width and a length direction.

Referring to FIGS. 15 and 16, an inner fin 871*af*1 for enhancing the heat transfer performance of a heater 871*b* is protruded and formed within the heater case. The inner fin 871*af*1 may be integrally formed on the heater case as a protruded configuration during the fabrication of the heater case (for example, extrusion molding of aluminum) or attached to the heater case by welding, an adhesive or the like as an additional configuration.

When the inner fin 871*af*1 is formed within the heater case as described above, a contact area to working fluid (F) filled into the heater case may increase, thereby increasing a heat transfer rate of being transferred from the heater 871*b* to working fluid (F). Furthermore, the entire volume of the heater case may increase to increase heat capacity capable of receiving heat from the heater case, thereby receiving more heat generated from the heater 871*b*. As a result, it may be possible to enhance defrosting performance.

Moreover, a significant amount of heat generated from a heater 871*b* may be transferred to the heater case at a front side (in an upward direction of the present drawing) of the heater 871*b* [heat transfer to a rear side of the heater 871*b* relatively decreases), thereby preventing the overheating of the heater 871*b*. Furthermore, a rear temperature of the heater 871*b* is reduced to enhance the reliability and lifespan of the heater 871*b*. Moreover, heat transfer to a sealing member 871*e* provided at a rear side of the heater 871*b* decreases to prevent the melting of the sealing member 871*e*.

Hereinafter, the configuration of the inner fin 871*af*1 will be described in more detail.

As illustrated in the drawing, the inner fin 871*af*1 is protruded and formed on an inner surface at an inner side of an outer surface to which the heater 871*b* is attached on the main case 871*a*1. According to the present drawing, it is seen that the heater 871*b* is attached to an outer bottom surface of the main case 871*a*1, and the inner fin 871*af*1 is protruded and formed on an inner bottom surface of the main case 871*a*1.

The inner fin 871*af*1 is preferably protruded and formed at a length less than ½ compared to an inner height of the main case 871*a*1. When the inner fin 871*af*1 is protruded and formed at a length larger than ½ compared to an inner height of the main case 871*a*1, it may prevent working fluid (F) from efficiently flowing.

A plurality of inner fins 871*af*1 may be provided, and extended and formed along a length or width direction of the main case 871*a*1 with a predetermined separation distance from each other. According to the present embodiment, it is seen that the inner fin 871*af*1 is extended and formed along a length direction of the main case 871*a*1. In case of having a structure in which the inner fin 871*af*1 is integrally formed with the main case 871*a*1 by the extrusion molding of the main case 871*a*1, it has a structure in which the inner fin 871*af*1 is extended and formed along a length direction of the main case 871*a*1.

Here, a separation distance between each other of the plurality of inner fins 871*af*1 is preferably set to be above one time compared to a width of the inner fin 871*af*1. It is because flowing between the plurality of inner fins 871*af*1 is significantly reduced when the separation distance between each other of the plurality of inner fins 871*af*1 is less than the width of the inner fin 871*af*1. Furthermore, a separation distance between each other of the plurality of inner fins 871*af*1 may be preferably set to be less than two times compared to the width of the width of the inner fin 871*af*1 such that a lot of inner fins 871*af*1 are provided within the main case 871*a*1 to obtain an effect due to the formation of the inner fin 871*af*1 at a satisfactory level.

In this viewpoint, a distance from an inner wall of the main case 871*a*1 and the inner fin 871*af*1 adjacent to the inner wall may be also preferably set to be greater than one time but less than two times compared to the width of the inner fin 871*af*1.

On the other hand, when working fluid (F) is all in a liquid phase, it is configured such that the working fluid (F) is completely filled into a vacant space within the main case 571*a*1 to transfer the maximum amount of heat to the working fluid (F). It may be satisfied as described above in case where the heater case is provided at a lower portion of the evaporator 130, and working fluid (F) greater than 30% but less than 40% compared to the entire internal volume of the heat pipe and heater case is filled.

Hereinafter, a structure capable of obtaining the effect due to the inner fin at a satisfactory level as well as efficiently discharging working fluid from the heater case while introducing working fluid to the heater case will be described.

Figure 17:
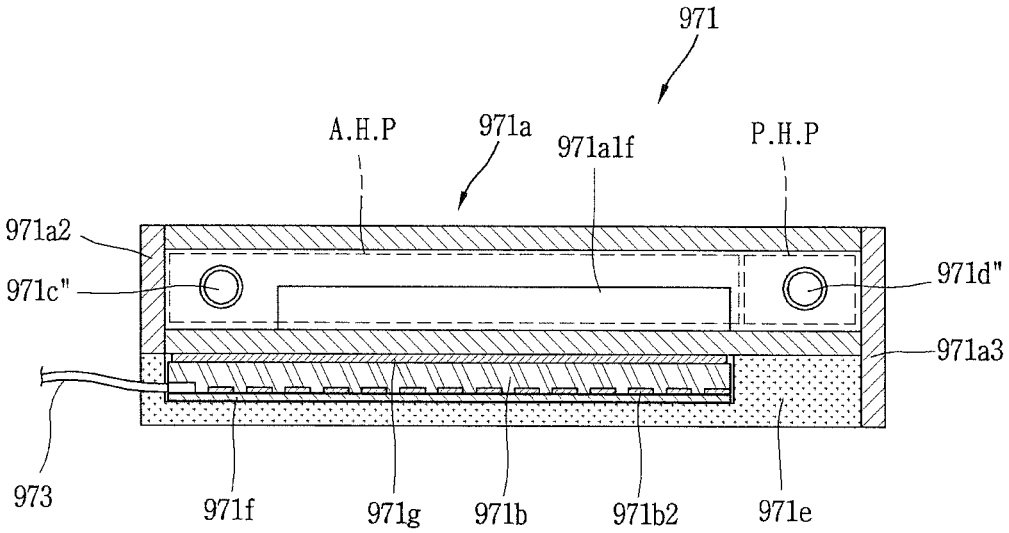
FIG. 17 is a cross-sectional view illustrating an example in which the formation positions of inner fins are modified in the heating unit illustrated in FIG. 16

FIG. 17 is a cross-sectional view illustrating an example in which the formation positions of inner fins 971*a*1 are modified in the heating unit 971 illustrated in FIG. 16.

According to the foregoing embodiment, it is shown a structure in which the inner fin 871*af*1 is extended and formed along a length direction of the main case 871*a*1 from one end of the main case 871*a*1 up to the other end thereof. As illustrated in FIG. 16, in a structure in which an outlet 871*c*" (an outlet at an opposite side is not shown) and an inlet 871*d*" (an inlet at an opposite side is not shown) are formed at positions separated from each other, respectively, with a predetermined distance along a length direction of the main case 871*a*1 on both lateral surfaces of the main case 871*a*1, the inner fin 871*af*1 is protruded and formed up to a height at which the inlet 871*d*" and outlet 871*c*" are formed. Accordingly, as illustrated in FIG. 16, the inner fin 871*af*1 is disposed to cover part of the outlet 871*c*" and inlet 871*d*" with a separation distance along a width direction of the main case 871*a*1.

The structure does not have a large effect on working fluid (F) discharged from the outlet 871*c*" and collected through the inlet 871*d*" but have some effect thereon in actuality when the inner fin 871*af*1 is protruded and formed at a length less than ½ compared to an inner height of the main case 871*a*1, and a distance between an inner wall of the main case 871*a*1 and the inner fin 871*af*1 adjacent to the inner wall is formed to be greater than one time compared to a width of the inner fin 871*af*1.

In order to improve this, according to the present modified example, it is seen that an inner fin 971*a*1*f* protruded and formed from an inner bottom surface of a main case 971*a*1 is formed between an inlet 971*d*" (an inlet at an opposite side is not shown) and an outlet 971*c*" (an outlet at an opposite side is not shown). According to the above-mentioned structure, the inner fin 971*a*1*f* does not cover the outlet 971*c*" and inlet 971*d*" of the main case 971*a*1 along a width direction of the main case 971*a*1. Accordingly, working fluid (F) may be efficiently collected through the inlet 971*d*", and the collected working fluid (F) receive more heat due to the inner fin 971*a*1*f* when heated again by the heater 971*b* while flowing forward, and the reheated working fluid (F) may be efficiently discharged through the outlet 971*c*".

Figure 18:
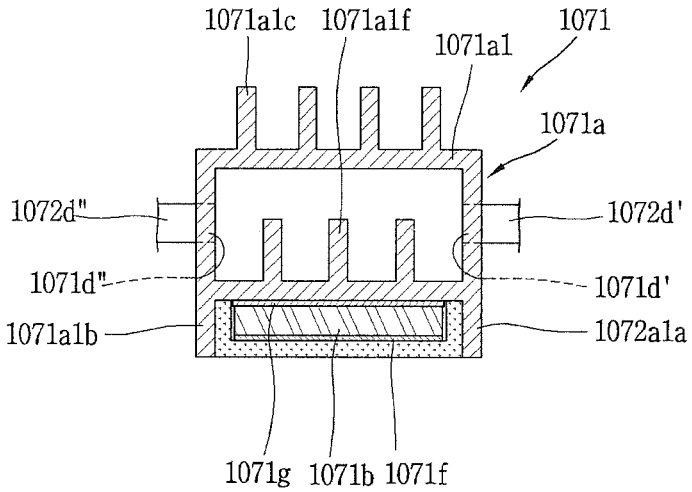
FIG. 18 is a cross-sectional view illustrating yet still another example of the heating unit illustrated in FIG. 3

FIG. 18 is a cross-sectional view illustrating yet still another example 1071 of the heating unit 171 illustrated in FIG. 3.

A structure illustrated in FIG. 18 may be understood in combination of structures associated with the foregoing outer fins and inner fins. In other words, an outer fin 1071*a*1*c* for the heat dissipation of a main case 1071*a*1 is protruded and formed on an outer surface of the main case 1071*a*1, and an inner fin 1071*a*1*f* for the heat transfer performance enhancement of a heater 1071*b* is protruded and formed within the main case 1071*a*1.

The structures of the foregoing embodiments may be all applicable to the structure of the present example. The redundant description thereof will be omitted.

On the other hand, when the heater 171*b* is driven, the removal of frost formed on the evaporator 130 is started. Specifically, working fluid (F) is heated by the heater 171*b* to flow through the heat pipe 172, and heat dissipation is carried out on the cooling tube 131 of the evaporator 130 during the process to melt frost or ice formed on the cooling tube 131. The frost or ice is converted into water, namely, defrost water, due to defrosting, and falls onto the bottom of the evaporator 130, and according to circumstances, defrost water may fall even on the heating unit 171 provided at a lower portion of the evaporator 130.

The hot wire 171*b*2 and terminal 171*b*3 of the heater 171*b*, and the lead wire 173 connected to the terminal 171*b*3 are configured to include a conductor, and thus there is a possibility of causing a short circuit when brought into contact with defrost water. As described above, it may be possible to prevent a contact between the heater 171*b* and defrost water at a predetermined level according to a structure in which the heater 171*b* is attached to a bottom surface of the heater case 171*a*, a structure in which the sealing member 171*e* is disposed to cover the heater 171*b*, and a structure in which the first and the second extension fin 171*a*1*a*, 171*a*1*b* are protruded and formed at both sides of the heater case 171*a* to accommodate the heater 171*b*.

However, the lead wire 173 has a shape of being exposed and extended to an outside of the heater case 171*a*. Due to such configuration characteristics, when defrost water flowed down to the lead wire 173 is cooled subsequent to defrosting and converted into frost or ice, the resultant weight increase may have an effect on contact with the terminal 171*b*3 or part of defrost water may flow to the side of the heater 171*b* or power along the lead wire 173 to cause a short circuit.

Hereinafter, a connection structure of the lead wire 173 according to the position of the heating unit 171 for preventing the foregoing problem will be described with reference to FIGS. 19 and 20.

The heating unit 171 is disposed in a shape of being extended along a left-right direction at a bottom portion of one side of the evaporator 130. The heating unit 171 may be disposed in a shape of being extended along a left-right direction of the evaporator 130 at the same height as that of the lowest column of the cooling tube 131 or a position lower than that of the lowest column of the cooling tube 131.

In the layout state, the lead wire 173 connected between the heater 171*b* and the power is extended from one end portion of the heater 171*b* adjacent to an outer side of the evaporator 130 to an outer side. In other words, the lead wire 173 is extended to an outer side other than an inner side of the evaporator 130 and connected to the power. According to the structure, an area in which the lead wire 173 is disposed to a lower side of the evaporator 130 may be minimized, thereby minimizing defrost water from falling onto the lead wire 173.

Figure 19:
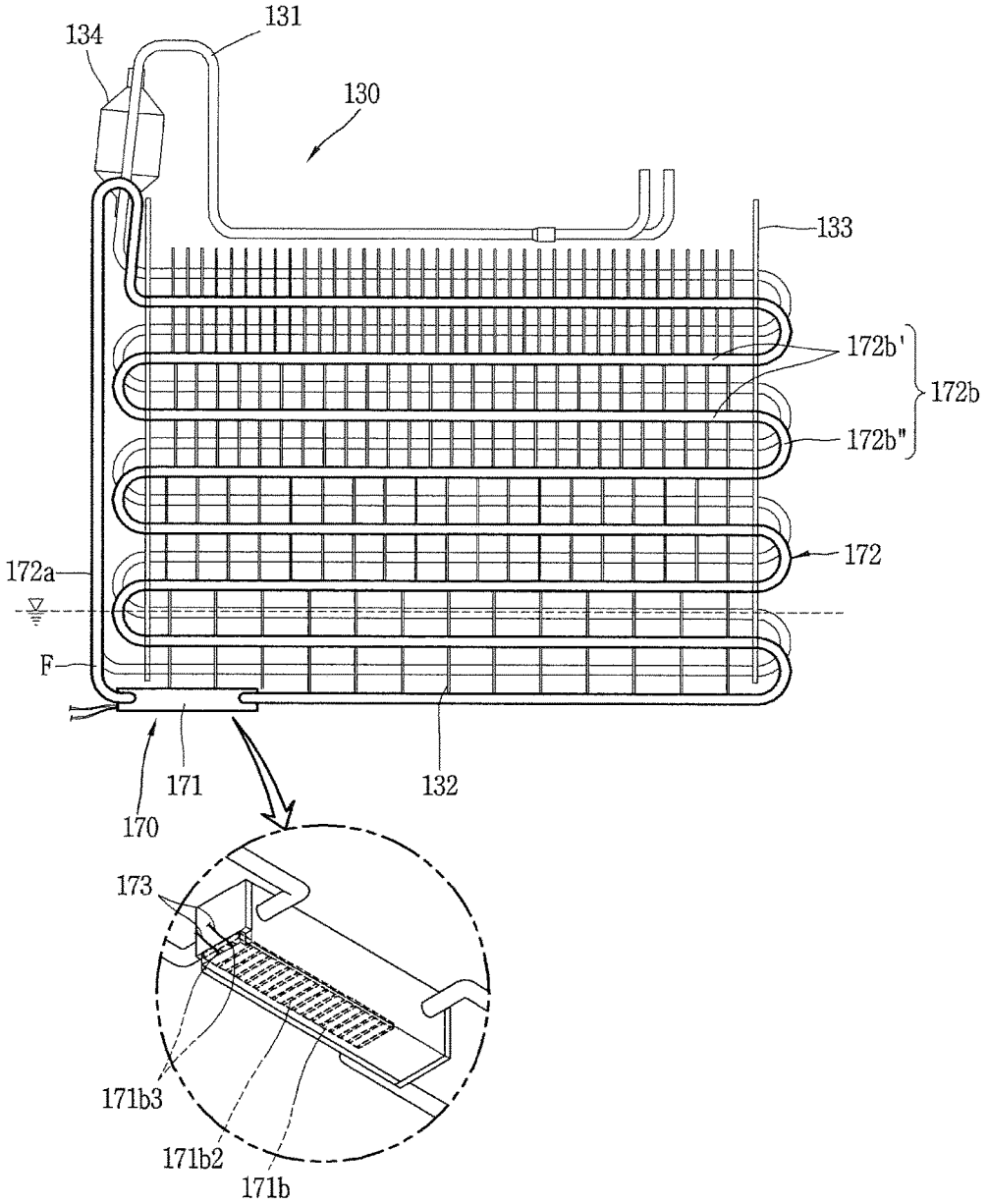
FIGS. 19 and 20 are conceptual views for explaining the connection structure of a lead wire according to the position of the heating unit

Considering specific examples thereof, first, FIG. 19 illustrates a view in which the heating unit 171 is disposed at a left bottom portion of the evaporator 130. The lead wire 173 is extended from a left end portion of the heater 171*b* adjacent to the left side of the evaporator 130 to an outer side. To this end, the terminal 171*b*3 connected to the lead wire 173 may be preferably located at a left end portion of the heater 171*b*.

Figure 20:
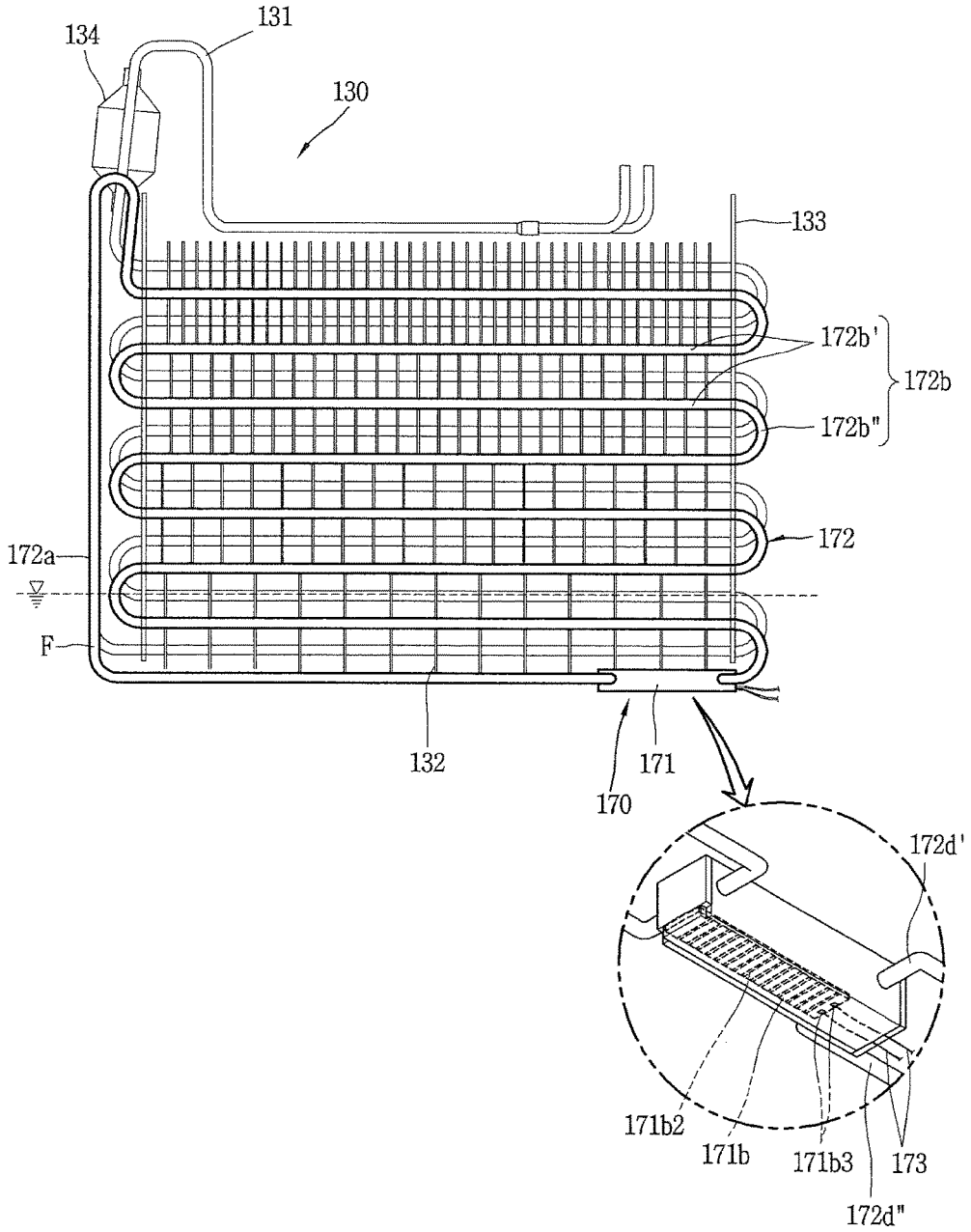

As an opposite case to FIG. 19, FIG. 20 illustrates a view in which the heating unit 171 is disposed at a right bottom portion of the evaporator 130. The lead wire 173 is extended from a right end portion of the heater 171*b* adjacent to the right side of the evaporator 130 to an outer side. To this end, the terminal 171*b*3 connected to the lead wire 173 may be preferably located between the inlet and the outlet adjacent to the inlet of the heater case 171*a*.

Here, the right end portion of the heater 171*b* may be preferably disposed between the inlet and the outlet of the heater case 171*a* to disallow working fluid (F) collected through the inlet located at the right end portion of the heater case 171*a* from being reheated to flow backward. According to the layout, the hot wire 171*b*2 is not disposed at the inlet of the heater case 171*a*, and thus the inlet is located within the passive heating part (PHP).

As illustrated in the drawing, when the return portion 172*d*', 172*d*" connected to the inlet of the heater case 171*a* is formed in a bent shape, the direction of the returned working fluid (F) is switched at least once just prior to being introduced into the heater case 171*a*. Here, a large flow resistance is formed at a bent portion, thereby preventing the returned working fluid (F) from being flowing backward.

For reference, the foregoing examples illustrate a case where the heater case 171*a* is disposed horizontally to the evaporator, but the present disclosure may not be necessarily limited to this. The heater case 171*a* may be disposed in such a manner that an inlet-side end portion is disposed within an angle range greater than −90° but less than 2° with respect to an outlet-side end portion. It will be described in detail later.

Figure 21A:
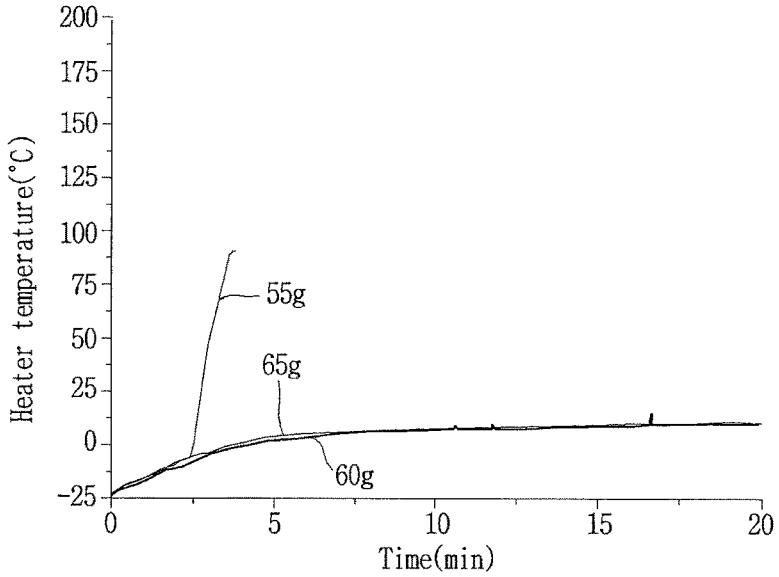
FIGS. 21A through 21C are graphs illustrating a temperature change of the heater for an inner diameter of a return portion illustrated in FIG. 4 in a freezing condition
Figure 21B:
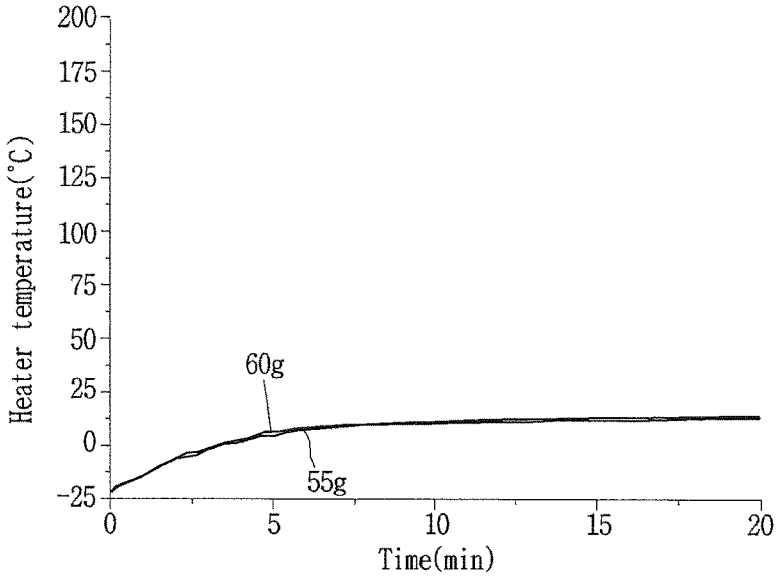
Figure 21C:
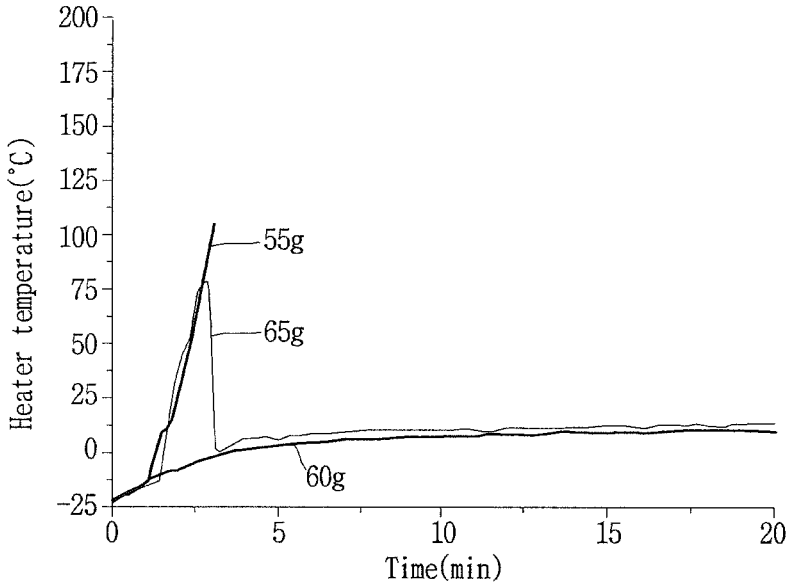
Figure 22:
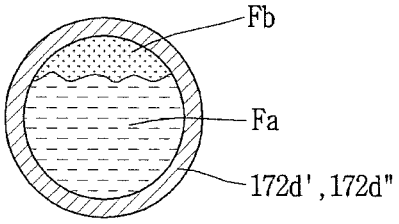
FIG. 22 is a view conceptually illustrating the flow of fluid at the return portion in the condition of FIG. 21C

FIGS. 21A through 21C are graphs illustrating a temperature change of the heater 171*b* for an inner diameter of a return portion 172*d*', 172*d*" illustrated in FIG. 4 in a freezing condition, and FIG. 22 is a view conceptually illustrating the flow of fluid at the return portion 172*d*', 172*d*" in the condition of FIG. 21C.

FIG. 21A is a view illustrating a case where an inner diameter of the return portion 172*d*', 172*d*" is 4.75 mm, and FIG. 21B is a view illustrating a case where the inner diameter of the return portion 172*d*', 172*d*" is 6.35 mm, and FIG. 21C is a view illustrating a case where the inner diameter of the return portion 172*d*', 172*d*" is 7.92 mm. In the present experiment, an appropriate amount of working fluid (F) was set to 55 g, 60 g and 65 g, respectively, to measure a temperature change of the heater 171*b* for an inner diameter of the return portion 172*d*', 172*d*".

As illustrated in FIG. 21A, in case where the inner diameter of the return portion 172*d*', 172*d*" is 4.75 mm, the overheating of the heater 171*b* occurred when the amount of working fluid (F) is 55 g. It is regarded that an amount of working fluid (F) returned to the heater case 171*a* is reduced compared to an appropriate amount due to a small diameter of the return portion 172*d*', 172*d*", and not sufficiently brought into contact with the heater 171*b* for heating the working fluid (F). When the diameter of the return portion 172*d*', 172*d*" is less than 5 mm as described above, it may cause a problem of overheating the heater 171*b*.

As illustrated in FIG. 21C, in case where the inner diameter of the return portion 172*d*', 172*d*" is 7.92 mm, the overheating of the heater 171*b* occurred when the amount of working fluid (F) is 55 g, 65 g. As described above, when the diameter of the return portion 172*d*', 172*d*" is greater than 7 mm, it occurred a phenomenon in which the collected working fluid (Fa) is all filled into the return portion 172*d*', 172*d*", and not collected into the heater case 171*a*, and flowed to a space formed at an upper portion within the return portion 172*d*', 172*d*" and introduced into the heater case 171*a*.

Here, working fluid (Fa) introduced into the heater case 171*a* is heated again by the heater 171*b* to strongly flow within the heating unit 171, and part of the heated working fluid (Fb) is discharged to an upper space within the return portion 172*d*', 172*d*", and as a result, it occurs a phenomenon in which part of the heated working fluid (Fb) flows backward.

As described above, the foregoing phenomenon occurs as an inner diameter of the return portion 172*d*', 172*d*" varies. Accordingly, in order to prevent the overheating of the heater 171*b* and the backflow of working fluid (F), the inlet 171*d*', 171*d*" should be formed within the passive heating part (PHP) as well as the return portion 172*d*', 172*d*" should have an appropriate inner diameter.

As a result of experiment, as illustrated in FIG. 21B, it is seen that the overheating of the heating unit 171 does not occur when an inner diameter of the return portion 172*d*', 172*d*" is 6.35 mm. It denotes that working fluid (F) can be efficiently returned, reheated and circulated. For reference, an amount of working fluid (F) used for the experiment is 55 g, 60 g, and it is a filling amount corresponding to 30-35% of the entire volume of the heat pipe 172 and heater case 171*a*.

As described above, an inner diameter of the return portion 172*d*', 172*d*" may be formed to be greater than 5 mm but less than 7 mm. Preferably, a commercial tube having an inner diameter of 6.35 mm within the above range may be used for the return portion 172*d*', 172*d*".

For reference, the heater case 171*a* having a specification with a width direction cross-section of 8 mm (height)×13 mm (width) was used for the foregoing experiment. The specification of the heater case 171*a* may be slightly different from the specification used for the foregoing experiment, the return portion 172*d*', 172*d*" having the above inner diameter condition may be used in a similar manner for the return portion 172*d*', 172*d*".

On the other hand, as described above, working fluid (F) heated and evaporated by the heater 171*b* within the heater case 171*a* is introduced into the entrance portion 172*c*', 172*c*" of the heat pipe 172, and working fluid (F) cooled while flowing through the heat pipe 172 is collected into the heater case 171*a* through the return portion 172*d*', 172*d*" of the heat pipe 172. During such a series of flow processes, an installation angle for the heater case 171*a* with respect to the heat pipe 172 performs a key role on whether or not working fluid (F) circulates. Hereinafter, it will be described in detail.

Figure 23:
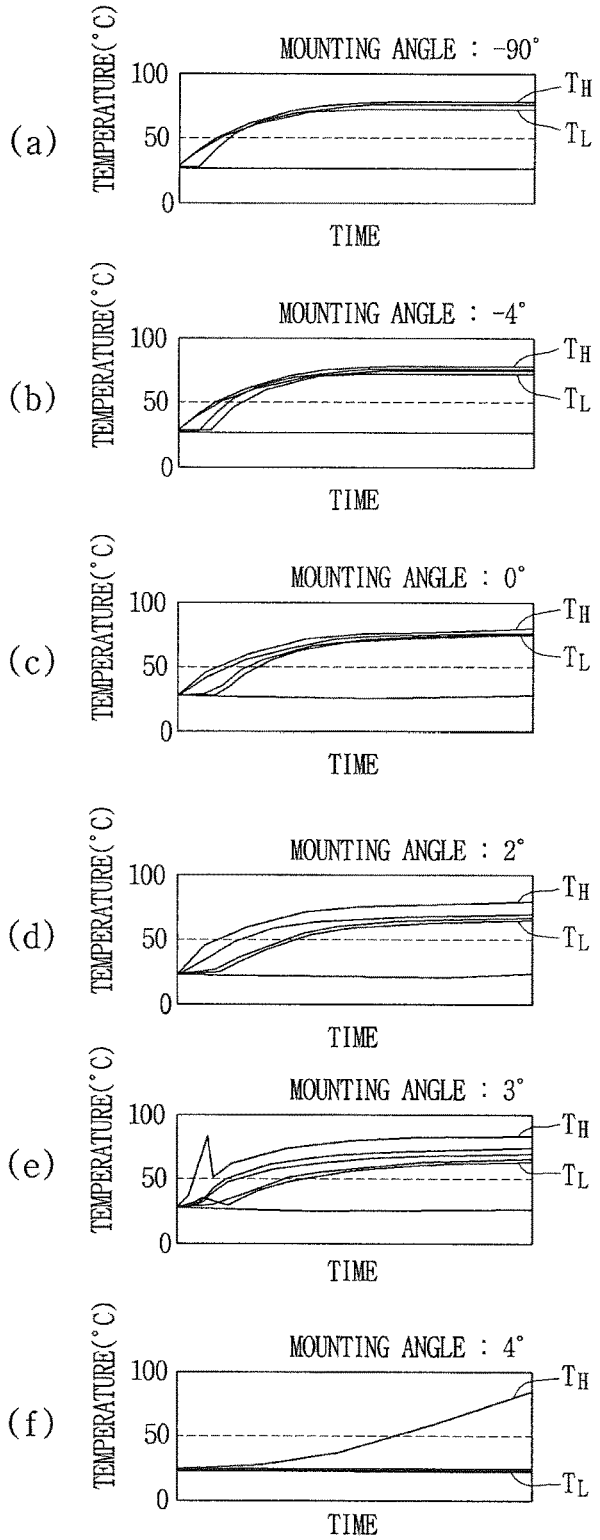
FIG. 23 is graphs illustrating a temperature change of each column of the heater case and heat pipe according to an angle at which an inlet-side end portion of the heater case is inclined with respect to an outlet-side end portion thereof

FIG. 23 is graphs illustrating a temperature change of each column of the heater case 171*a* and heat pipe 172 according to an angle at which an inlet 171*d*', 171*d*" side end portion of the heater case 171*a* is inclined with respect to an outlet 171*c*', 171*c*" side end portion thereof.

For reference, TH indicates a temperature of the heater case 171*a*, and TL indicates a temperature of the lowest column of the heat emitting part 172*b* of the heat pipe 172. Since working fluid (F) is heated by the heater 171*b* and circulated through the heat pipe 172, and then returned to the heater case 171*a*, the temperature (TH) of the heater case 171*a* is the highest, but the temperature (TL) of the lowest column of the heat emitting part 172*b* is the lowest. Accordingly, it is understood that the temperature of the remaining columns of the heat pipe 172 is between TH and TL. In FIG. 23, for the sake of convenience of explanation, only temperature curves corresponding to TH and TL are shown with indication lines.

Referring to the drawing, whether or not working fluid (F) efficiently circulates may vary according to an angle at which an inlet 171*d*', 171*d*" side end portion of the heater case 171*a* is inclined with respect to an outlet 171*c*', 171*c*" side end portion thereof. In case of a structure in which the heater case 171*a* is extended and formed in one direction, and the inlet 171*d*', 171*d*" and outlet 171*c*', 171*c*" are formed at both sides thereof, respectively, it relates to an angle at which an inlet 171*d*', 171*d*" side end portion of the heater case 171*a* is inclined with respect to an outlet 171*c*', 171*c*" side end portion thereof.

The angle 0° denotes a configuration in which the heater case 171*a* is disposed horizontally to the evaporator 130, and a positive (+) angle denotes a configuration in which an inlet 171*d*', 171*d*" side end portion of the heater case 171*a* is inclined upward with respect to an outlet 171*c*', 171*c*" side end portion thereof, and a negative (−) angle denotes a configuration in which an inlet 171*d*', 171*d*" side end portion of the heater case 171*a* is inclined downward with respect to an outlet 171*c*', 171*c*" side end portion thereof.

As illustrated in FIG. 23A through 23C, when the heater case 171*a* is disposed horizontally to the evaporator 130 or an inlet 171*d*', 171*d*" side end portion of the heater case 171*a* is inclined downward with respect to an outlet 171*c*', 171*c*" side end portion thereof (when the outlet 171*c*', 171*c*" side is formed at the same height as that of the inlet 171*d*', 171*d*" side or the outlet 171*c*', 171*c*" side is formed at a higher height than that of the inlet 171*d*', 171*d*" side), the temperature of each column of the heat pipe 172 similarly increases according to the passage of time, and reaches a stable operating temperature subsequent to the passage of a predetermined period of time. It denotes that the circulation of working fluid (F) is efficiently carried out.

As a result of experiment, when an end portion of the inlet 171*d*', 171*d*" of the heater case 171*a* is disposed within a range between 0° and −90° with respect to an outlet 171*c*', 171c" side end portion thereof, it is seen that a temperature curve according to the passage of time has no problem in circulating working fluid (F) through the heat pipe 172.

On the contrary, referring to FIGS. 23D and 23F, when an inlet 171d', 171d" side end portion of the heater case 171a is inclined upward with respect to an outlet 171c', 171c" side end portion thereof (when the outlet 171c', 171c" side is formed at a lower position than that of the inlet 171d', 171d" side), it is shown that the temperature of each column of the heater case 171a and heat pipe 172 has a large difference for each angle.

Specifically, in a state that an inlet 171d', 171d" side end portion of the heater case 171a is inclined upward by 2° with respect to an outlet 171c', 171c" side end portion thereof (in a state that the inlet 171d', 171d" side is inclined upward by 2° with respect to the outlet 171c', 171c" side), it does not show a large difference from the foregoing graphs.

However, in a state that an inlet 171d', 171d" side end portion of the heater case 171a is inclined upward by 3° with respect to an outlet 171c', 171c" side end portion thereof (in a state that the inlet 171d', 171d" side is inclined upward by 3° with respect to the outlet 171c', 171c" side), it is seen that the temperature of the heater case 171a suddenly rapidly increases and decreased at an initial stage. Furthermore, in a state that an inlet 171d', 171d" side end portion of the heater case 171a is inclined upward by 4° with respect to an outlet 171c', 171c" side end portion thereof (in a state that the inlet 171d', 171d" side is inclined upward by 4° with respect to the outlet 171c', 171c" side), it is seen that the temperature of the heater case 171a continuously increases, and the heat pipe 172 is not largely deviated from an initial temperature.

It denotes that even if working fluid (F) is heated by the heater 171b, it is difficult to flow down toward the entrance portion 172c', 172c" in which the working fluid (F) is located at a relatively lower position when an inlet 171d', 171d" side end portion of the heater case 171a is inclined upward more than 3° with respect to an outlet 171c', 171c" side end portion thereof (in a state that the inlet 171d', 171d" side is inclined upward more than 3° with respect to the outlet 171c', 171c" side).

In particular, when an inlet 171d', 171d" side end portion of the heater case 171a is inclined upward more than 4° with respect to an outlet 171c', 171c" side end portion thereof (in a state that the inlet 171d', 171d" side is inclined upward more than 4° with respect to the outlet 171c', 171c" side), working fluid (F) does not flow down toward the entrance portion 172c', 172c" but flow backward not to allow circulation, and thus the temperature of the heater case 171a continuously increases to cause overheating.

Considering the experimental result, an inlet 171d', 171d" side end portion of the heater case 171a may be preferably disposed to have an angle range greater than −90° but less than 2° with respect to an outlet 171c', 171c" side end portion thereof.

For reference, it is seen that the temperature of the lowest column of the heater 171b of the heat pipe 172 more rapidly increases when FIGS. 23A through 23C are compared with each other, as an inlet 171d', 171d" side end portion of the heater case 171a is disposed to be inclined downward with respect to an outlet 171c', 171c" side end portion thereof. It is because the flow of working fluid (F) is easily carried out as the outlet 171c', 171c" side of the heater case 171a is disposed upward with respect to the inlet 171d', 171d" side thereof.

Hereinafter, a connection structure between the heating unit 171 and the heat pipe 172 for easily carrying out the flowing of working fluid (F) in consideration of a rising characteristic of heated working fluid (F) will be described.

Figure 24:
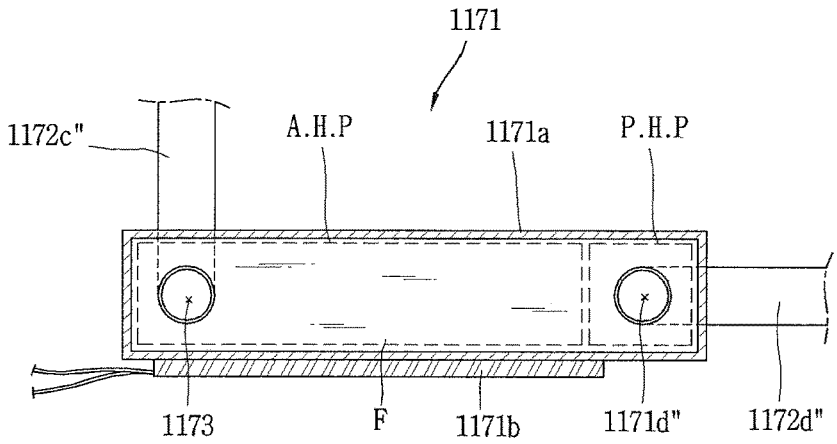
FIGS. 24 through 26 are longitudinal cross-sectional views illustrating a modified example of a connection structure between a heating unit and a heat pipe in the heating unit applied to FIGS. 19 and 20
Figure 25:
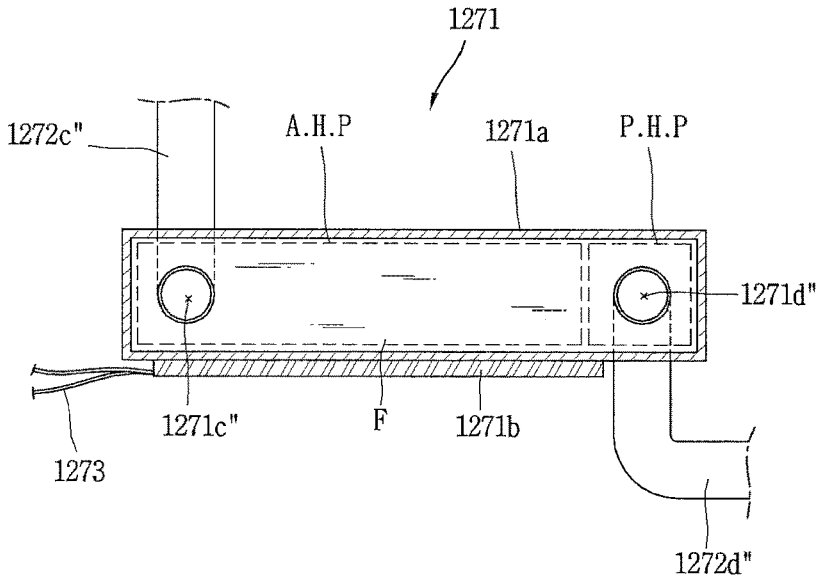
Figure 26:
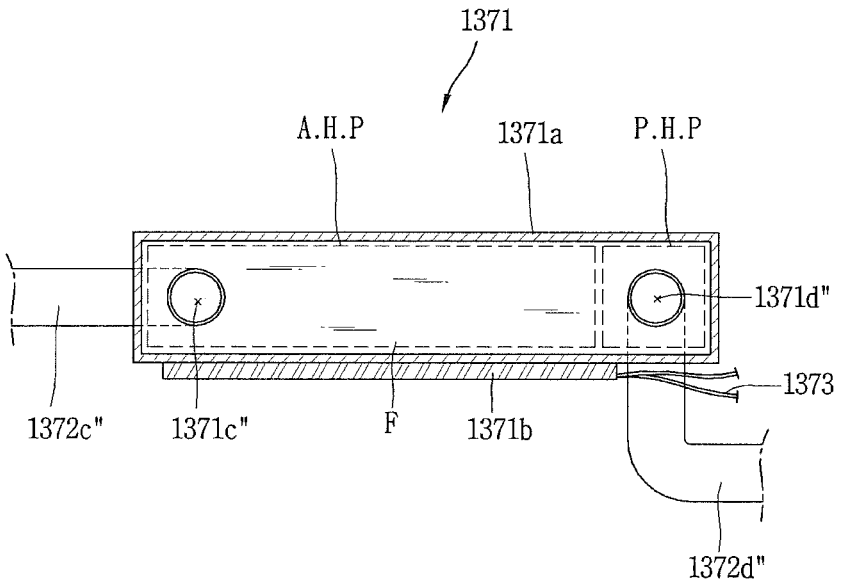

FIGS. 24 through 26 are longitudinal cross-sectional views illustrating a modified example of a connection structure between the heating unit 171 and the heat pipe 172 in the heating unit 171 applied to FIGS. 19 and 20. For reference, the present drawings briefly illustrate a heating unit 1171, 1271, 1371 with only a heater case 1171a, 1271a, 1371a and a heater 1171b, 1271b, 1371b for the sake of convenience of explanation. The foregoing detailed structure (a structure formed with first and second extension fins, a sealing member, outer fins, inner fins, and the like) may be of course applicable to the heating unit 1171, 1271, 1371.

Hereinafter, the present disclosure will be describes based on that the heater case 1171a, 1271a, 1371a is disposed horizontally to the evaporator, but the present disclosure may not be necessarily limited to this. As described above, the heater case 1171a, 1271a, 1371a may be disposed such that an inlet 1171d", 1271d", 1371d" (an inlet at an opposite side is not shown) side end portion has an angle range greater than −90° but less than 2° with respect to an outlet 1271c", 1271c", 1371c" (an outlet at an opposite side is not shown).

Moreover, hereinafter, the present disclosure will be described based on that the inlet 1171d", 1271d", 1371d" and outlet 1271c", 1271c", 1371c" are formed at positions separated by a predetermined distance along a length direction at both lateral surfaces of the heater case 1171a, 1271a, 1371a (a structure illustrated in the above FIG. 4), but the present disclosure may not be necessarily limited to this. At least one of the inlet 1171d", 1271d", 1371d" and outlet 1271c", 1271c", 1371c" of the heating unit 1171, 1271, 1371 may be formed at an end portion of the heater case 1171a, 1271a, 1371a (a structure illustrated in the above FIGS. 7 through 9).

As described above, working fluid (F) is collected through the inlet 1171d", 1271d", 1371d" and then heated again by the heater 1171b, 1271b, 1371b and discharged to the outlet 1271c", 1271c", 1371c". In consideration of the flow direction of working fluid (F) and the rising characteristic of heated working fluid (W), a return portion 1172d", 1272d", 1372d" of the heat pipe (an opposite side is not shown) may be disposed in parallel to the heater case 1171a, 1271a, 1371a or extended and formed (or extended downward and bent to be horizontally extended and formed) in a downward direction of the heater case 1171a, 1271a, 1371a, and an entrance portion 1172c", 1272c", 1372c" of the heat pipe (an opposite side is not shown) may be disposed in parallel to the heater case 1171a, 1271a, 1371a or extended and formed in an upward direction of the heater case 1171a, 1271a, 1371a.

Here, the meaning of being extended and formed in an upward and/or downward direction may include being extended and formed in a vertical manner as well as being extended and formed in an inclined manner.

Moreover, in a combination of the cases, both the return portion 1172d", 1272d", 1372d" and entrance portion 1172c", 1272c", 1372c" may be extended and formed along a length direction of the heater case 1171a, 1271a, 1371a, but in the aspect of flow design in consideration of a rising force of working fluid (F), only either one of the return portion 1172d", 1272d", 1372d" and entrance portion 1172c", 1272c", 1372c" may be preferably extended and formed along a length direction of the heater case 171a.

For an example, FIG. 24 illustrates a view in which the return portion 1172d" of the heat pipe is extended and formed along a length direction of the heater case 1171a, and the entrance portion 1172*c*" of the heat pipe is extended and formed in an upward direction of the heater case 1171*a*.

For another example, FIG. 25 illustrates a view in which the return portion 1272*d*" of the heat pipe is extended and formed in a downward direction of the heater case 1271*a*, and the entrance portion 1272*c*', 1272*c*" of the heat pipe is extended and formed in an upward direction of the heater case 1271*a*.

The foregoing two examples may be applicable to a structure in which the heating unit 171 is directly connected to a vertical extension portion of the heat pipe 172 as illustrated in FIG. 19 in the aspect that the entrance portion 1172*c*", 1272*c*" of the heat pipe is extended and formed in an upward direction of the evaporator. In this case, a lower end portion of the vertical extension portion constitutes the entrance portion 1172*c*", 1272*c*".

For reference, as illustrated in FIG. 19, the foregoing two examples are configured such that the a terminal (not shown) of the heater 1171*b*, 1271*b* is formed adjacent to an outlet 1271*c*", 1271*c*" of the heater case 1171*a*, 1271*a*, and a lead wire 1173, 1273 is connected to the terminal and extended to an outside.

According to the above structure, natural flow is formed such that working fluid (F) heated by the heater 1171*b*, 1271*b* is raised and discharged to the entrance portion 1172*c*", 1272*c*" extended and formed upward, and thus working fluid (F) heated by the heater 1171*b*, 1271*b* may be efficiently discharged through the entrance portion 1172*c*", 1272*c*" even in a state that the heater case 1171*a*, 1271*a* is disposed in a horizontal manner.

In particular, the structure illustrated in FIG. 25 is a structure in which working fluid (F) heated to have a rising force is unable to flow backward to the return portion 1272*d*" as the return portion 1272*d*" of the heat pipe 1272 has a structure of being extended and formed at a downward direction of the heater case 1271*a*. Accordingly, it may be possible to form a more natural flow of discharging the heated working fluid (F) through the entrance portion 1272*c*" without flowing backward to the return portion 1272*d*".

For another example, in FIG. 26, it is shown that the return portion 1372*d*" of the heat pipe 1372 is extended and formed in a downward direction of the heater case 1371*a*, and the entrance portion 1372*c*" of the heat pipe 1372 is extended and formed along a length direction of the heater case 1371*a*.

The foregoing structure may be applicable to a structure in which the heating unit 171 is directly connected to a horizontal extension portion of the heat pipe 172 as illustrated in FIG. 20 in the aspect that the entrance portion 1372*c*" of the heat pipe 1372 is extended and formed along a length direction of the heater case 1371*a*. In this case, an end portion of the horizontal extension portion constitutes the entrance portion 1372". For reference, as described in association with FIG. 20, in the above example, it is configured such that a terminal (not shown) of the heater 1371*b* is formed between the inlet 1371*d*" and the outlet 1371*c*" of the heater case 1371*a*, and the led wire 1373 is connected to the terminal and extended to an outside.

It is not a discharge structure appropriate to a characteristic of raising heated working fluid (F) compared to the foregoing structures, but working fluid (F) heated to have a rising force is unable to flow backward to the return portion 1372*d*" as the return portion 1372*d*" of the heat pipe 1372 has a structure of being extended and formed at a downward direction of the heater case 1371*a*. Accordingly, it may be possible to form a series of flows of discharging heated working fluid (F) through the entrance portion 1372*c*".

On the other hand, the heater case 1471*a* may be extended and formed in a vertical direction from a lower side of the evaporator 1430 to an upper side thereof such that an inlet 1471*d*" (an inlet at an opposite side is not shown) side end portion forms an angle of −90° with respect to an outlet 1471*c*" (an outlet at an opposite side is not shown) side end portion.

Figure 27:
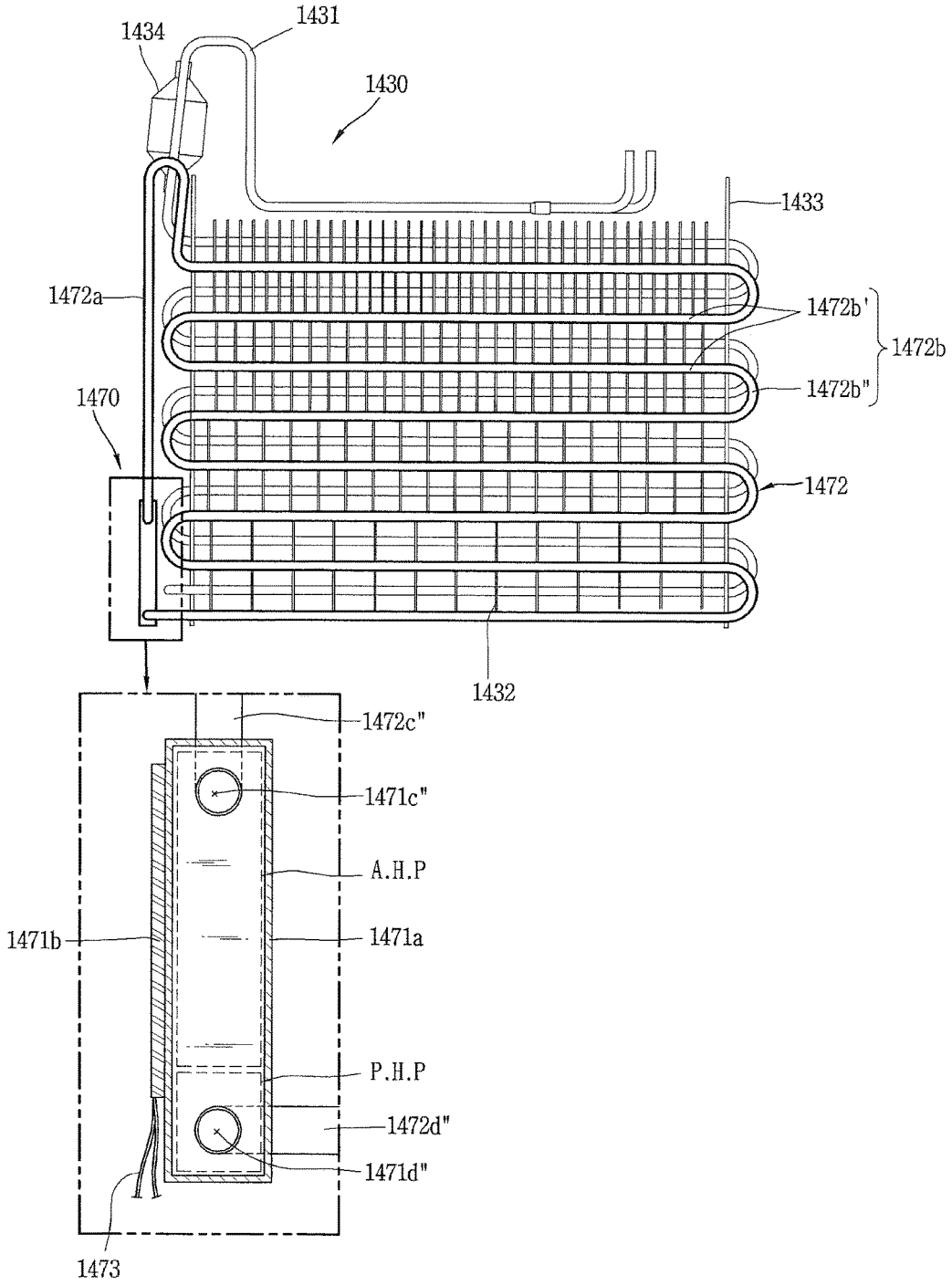
FIGS. 27 and 28 are a front view and a perspective view illustrating a second embodiment of a defrosting device applied to the refrigerator in FIG. 1
Figure 28:
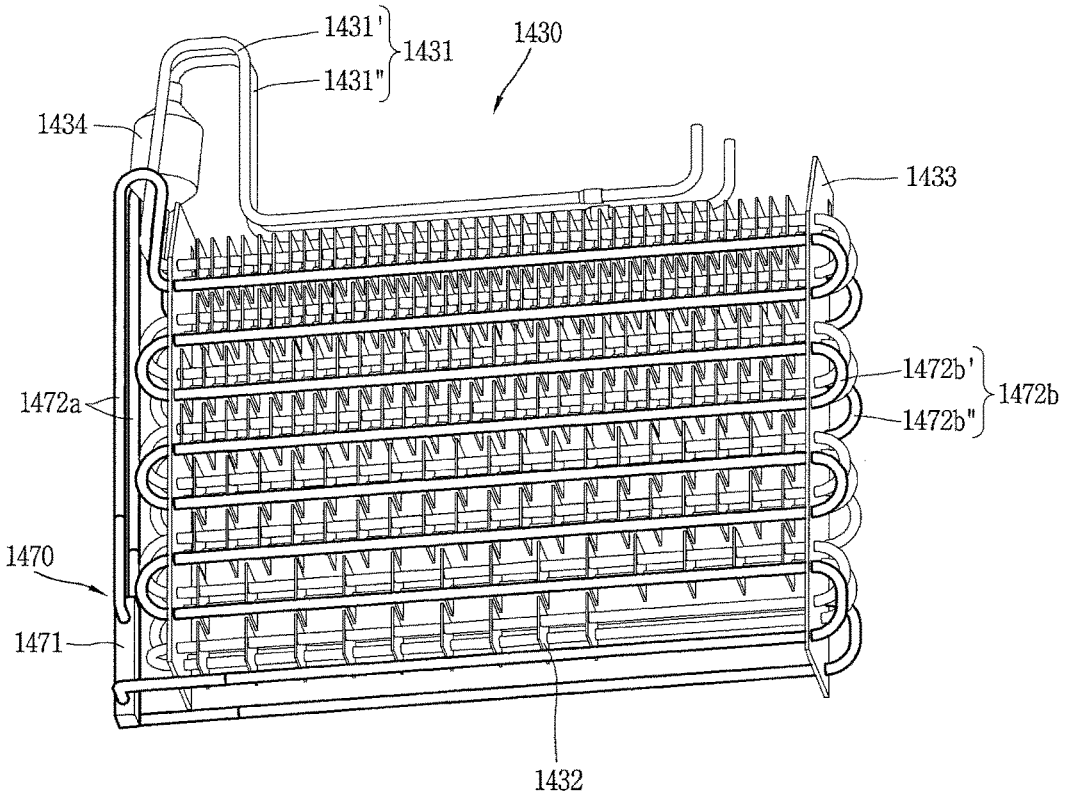

FIGS. 27 and 28 are a front view and a perspective view illustrating a second embodiment 1470 of the defrosting device 170 applied to the refrigerator 100 in FIG. 1.

Referring to FIGS. 27 and 28, a heating unit 1471 may be disposed at one outer side of a defrosting device 1470. Specifically, a heater case 1471*a* may be located at an outer side of a support fixture 1433 provided at one side of an evaporator 1430, and extended and formed in a vertical direction from a lower side of the evaporator 1430 to an upper side thereof. Here, at least part of the heater case 1471*a* may be disposed between a first cooling tube 1431' and a second cooling tube 1431"

The heater case 1471*a* is connected to heat pipes 1472, respectively, to form a passage capable of circulating working fluid (F). An outlet 1471*c*" and an inlet 1471*d*" are formed at an upper and a lower side of the heater case 1471*a*, respectively. The outlet 1471*c*" is connected to an extension portion of the heat pipe 1472, and the inlet 1471*d*" is connected to the lowest column of the heat pipe 1472.

A heater 1471*b* is configured with a plate-shaped heater 1471*b* extended and formed along one direction, and attached to an outer surface of the heater case 1471*a* and vertically disposed in a top-down direction of the evaporator 1430. For reference, FIG. 27 briefly illustrates the heater case 1471*a* with only the heater case 1471*a* and heater 1471*b* for the sake of convenience of explanation. The foregoing detailed structure (a structure formed with first and second extension fins, a sealing member, outer fins, inner fins, and the like) may be of course applicable to the heating unit 1471.

According to the present embodiment, it is shown that the heater 1471*b* is attached to one surface of the heater case 1471*a* facing outward. According to the layout, it may be possible to prevent defrost water from being brought into contact with the heater 1471*b* at a predetermined level. However, the present disclosure may not be necessarily limited to this. The heater 1471*b* may be also attached to another surface of the heater case 1471*a* facing the support fixture 133. However, in this case, a structure capable of preventing contact between the heater 1471*b* and defrost water may be preferably provided.

For reference, when the heater 1471*b* is attached to one surface of the heater case 1471*a* facing outward, an outer fin may be protruded and formed on another surface of the heater case 1471*a* facing the support fixture 133, and an inner fin may be protruded and formed on an inner surface of an inner side of one surface to which the heater 1471*b* is attached.

A hot wire 1471*b*2 of the heater 1471*b* is extended and formed between the inlet 1471*d*" and the outlet 1471*c*" toward the outlet 1471*c*", and configured to reheat working fluid (F) collected through the inlet 1471*d*". A terminal (not shown) of the heater 1471*b* may be formed at an end portion of the heater 1471*b* located between the inlet 1471*d*" and the outlet 1471*c*", and a lead wire 1473 is connected to the terminal and extended toward a lower side of the evaporator 1430.

On the other hand, working fluid (F) may be preferably filled at a higher position than that of the highest end of the heater 1471*b* extended in a vertical direction within the heater case 1471*a*. According to the foregoing configuration, defrosting operation may be stably carried out in a state that the heating unit 1471 is not overheated, and the continuous supply of working fluid (F) in a gas phase to the heat pipe 1472 may be stably carried out.

Hereinafter, a design change of a heat pipe 1572 in consideration of convection according to a temperature of working fluid (F) when the working fluid (F) circulates the heat pipe 1572 will be described.

Figure 29:
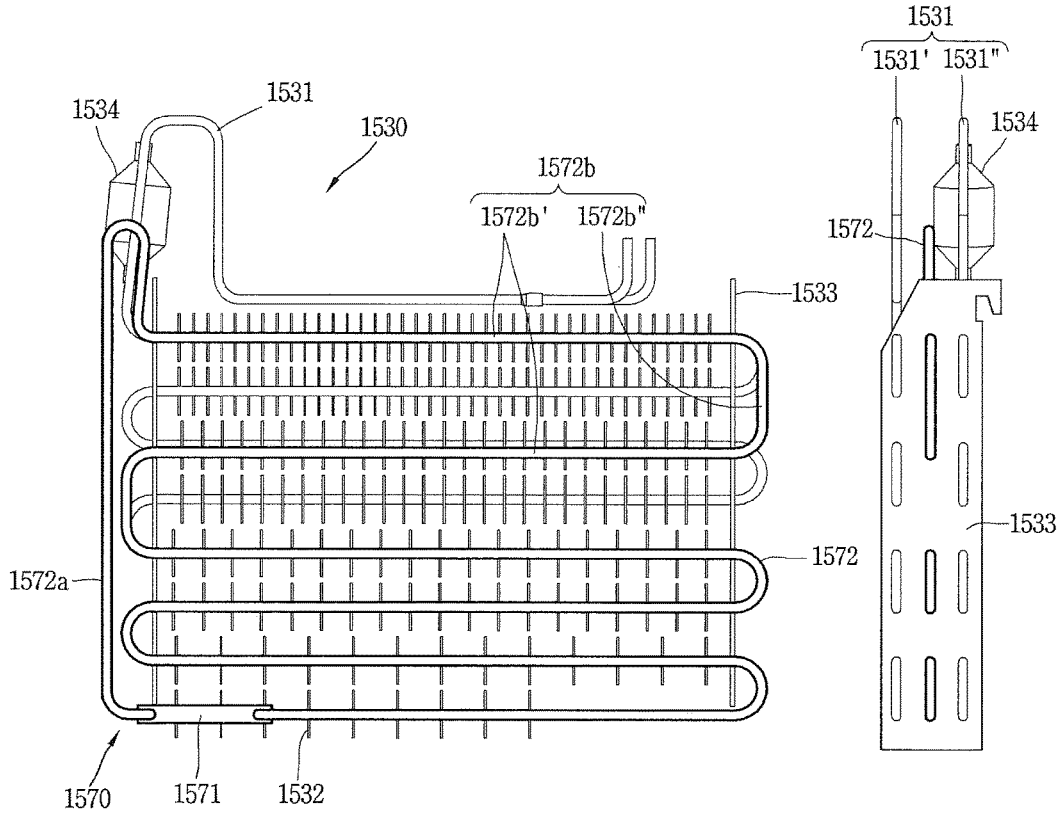
FIG. 29 is a conceptual view illustrating a third embodiment in which a width between upper columns and lower columns of the heat pipe is differently formed in a defrosting device applied to the refrigerator in FIG. 1

FIG. 29 is a conceptual view illustrating a third embodiment 1570 in which a width between upper columns and lower columns of the heat pipe 1572 is differently formed in the defrosting device 170 applied to the refrigerator 100 in FIG. 1. According to the present embodiment, the defrosting device 1570 is shown on a front surface (a) and a lateral surface (b) thereof.

For reference, FIG. 29A illustrates a configuration that a first cooling tube 1531' at a front side is omitted to exhibit the entire shape of the heat pipe 1572. Furthermore, part of a second cooling tube 1531" may not be seen due to overlapping with the heat pipe 1572, but referring to the layout of a cooling fin 1532 and FIG. 29B, the entire shape of the first and the second cooling fin 1531', 1521" may be seen.

Referring to FIG. 29, the cooling tube 1531 and heat pipe 1572 are repeated bent in a zigzag shape to form a plurality of columns.

Specifically, the cooling tube 1531 may be configured with a combination of horizontal pipe portions and bending pipe portions. The horizontal pipe portions are horizontally disposed in a top-down direction, and configured to pass through cooling fins 1532, and the bending pipe portions are connected between an end portion of an upper horizontal pipe portion and an end portion of a lower horizontal pipe portion to communicate with each other. Here, each column of the horizontal pipe portions may be disposed at predetermined intervals as illustrated in the drawing.

The heat pipe 1572 is disposed between a first cooling tube 1531' and a second cooling tube 1531" to form a single row. The heat pipe 1572 may include an extension portion 1572*a* and a heat emitting part 1572*b*. The description of the extension portion 1572*a* will be substituted by the description of previous embodiment.

The heat emitting part 172*b* is extended in a zigzag shape along the cooling tube 1531 of the evaporator 1530 from the extension portion 1572*a* connected to an inlet of the heating unit 1571. The heat emitting part 1572*b* is configured in combination with a plurality of horizontal tubes 1572*b*' constituting columns and a connecting tube 1572*b*" formed in a bent U-shaped tube to connect them in a zigzag shape.

In the foregoing structure, a distance between each column of the horizontal tubes 1572*b*' at a lower portion thereof may be formed to be smaller than that of horizontal tubes 1572*b*' at an upper portion thereof. It is a design in consideration of convection according to a temperature of working fluid (F) when the working fluid (F) circulates the heat pipe 1572.

Specifically, working fluid (F) introduced through the entrance portion of the heat pipe 1572 is in a high-temperature gas phase, and has the highest temperature during the circulation process of the heat pipe 1572. As illustrated in the drawing, high-temperature working fluid (F) moves toward the cooling tube 1531, and thus high-temperature heat is transferred to a large area by convection around the cooling tube 1531 at an upper portion thereof.

On the contrary, working fluid (F) flows in a state that in a phase that liquid and gas coexist while gradually losing heat, and is finally introduced into the return portion, and the heat at this time is a sufficient temperature for removing frost on the cooling tube 1531, but an amount of heat transfer to the surrounding is smaller than the former case.

Accordingly, in consideration of this, each column of the heat pipe 1572 close to the return portion (namely, the horizontal tubes 1572*b*' of the heat emitting part 1572*b*) is disposed with a smaller distance compared to that of the heat pipe 1572 located at an upper portion thereof. For example, each column of the heat pipe 1572 located at an upper portion thereof may be disposed to correspond to a column of the adjoining cooling tube 1531 by interposing one column of the cooling tube 1531 therebetween, and each column of the heat pipe 1572 located at a lower portion thereof may be disposed to correspond to each column of the cooling tube 1531.

Accordingly the foregoing structure, a lower portion of the evaporator 1530 is arranged with a relatively larger number of horizontal tubes 1572*b*' of the heat emitting part 1572*b* than that of an upper portion thereof.

Figure 30:
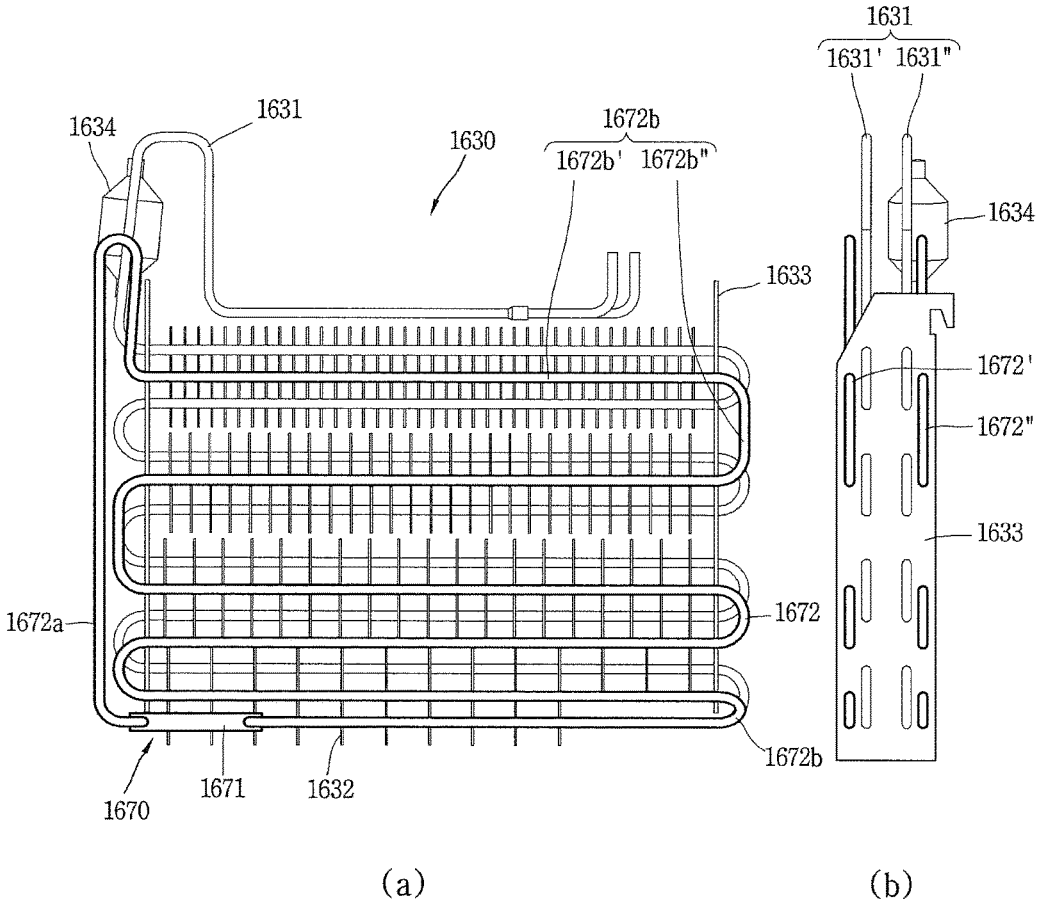
FIGS. 30 and 31 are conceptual views illustrating a modified example of the defrosting device illustrated in FIG. 29
Figure 31:
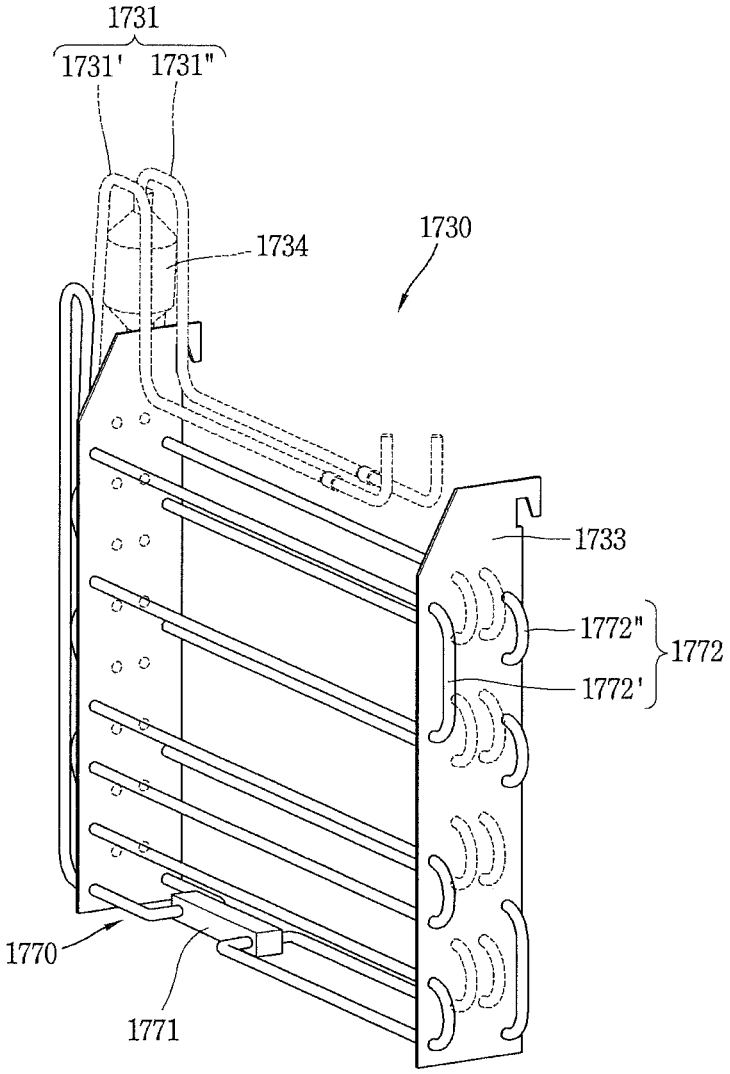

FIGS. 30 and 31 are conceptual views illustrating a modified example 1670 of the defrosting device 1570 illustrated in FIG. 29.

First, FIG. 30 illustrates a front surface (a) and a lateral surface (b) of the defrosting device 1670.

According to the present modified example, a heat pipe 1672 may include a first heat pipe 1672' at a front side of a first cooling tube 1631' and a second heat pipe 1672" at a rear side of a second cooling tube 1631" to form two columns.

For reference, the second heat pipe 1672" may not be seen due to overlapping with the first heat pipe 1672' in FIG. 30A, but referring to FIG. 30B, the entire shape of the second cooling fin 1672" may be seen.

As illustrated in the drawing, a distance between each column of the horizontal tubes 1672*b*' disposed at a lower portion of the first and the second heat pipe 1672', 1672" may be formed to be smaller than that between each column of the horizontal tubes 1672*b*' disposed at an upper portion thereof. It is a design in consideration of convection according to a temperature of working fluid (F) when the working fluid (F) circulates the heat pipe 1672, and the detailed description thereof will be substituted by the earlier description of FIG. 29.

Next, FIG. 31 illustrates a view in which part of a first and a second cooling tube 1731', 1731" is omitted to help understanding.

Referring to FIG. 31, a distance between each column disposed at a lower portion of a first heat pipe 1772' at a front side of an evaporator 1730 may be formed to be smaller than that of each column disposed at an upper portion thereof. On the contrary, a distance between each column disposed at an upper portion of a first heat pipe 1772' at a rear side of the evaporator 1730 may be formed to be smaller than that of each column disposed at an lower portion thereof.

According to the layout relationship, a temperature decrease due to any one portion having a smaller distance of the heat pipe 1772 may be compensated by a temperature increase due to another portion having a smaller distance of the heat pipe 1772. Accordingly, the present disclosure may implement an efficient heat transfer structure to a cooling tube 1731 while the first and the second heat pipe 1772', 1772" are configured to be shorter than the basic structure (a structure illustrated in FIG. 3).

For a modified example for this, a distance between each column disposed at a lower portion of the first heat pipe 1772' at a front side of the evaporator 1730 may be formed to be larger that between each column disposed at an upper portion thereof. On the contrary, a distance between each column disposed at an upper portion of the second heat pipe 1772" at a rear side of the evaporator 1730 may be formed to be larger that between each column disposed at a lower portion thereof.

On the other hand, as working fluid (F) dissipates heat to a cooling tube 1831 while flowing a heat pipe 1872, the working fluid (F) is cooled when closer to an inlet of a heating unit 1871. Accordingly, defrosting for a lower cooling tube 1731 may not be efficiently carried out. Hereinafter, a structure capable of solving this problem will be described.

Figure 32:
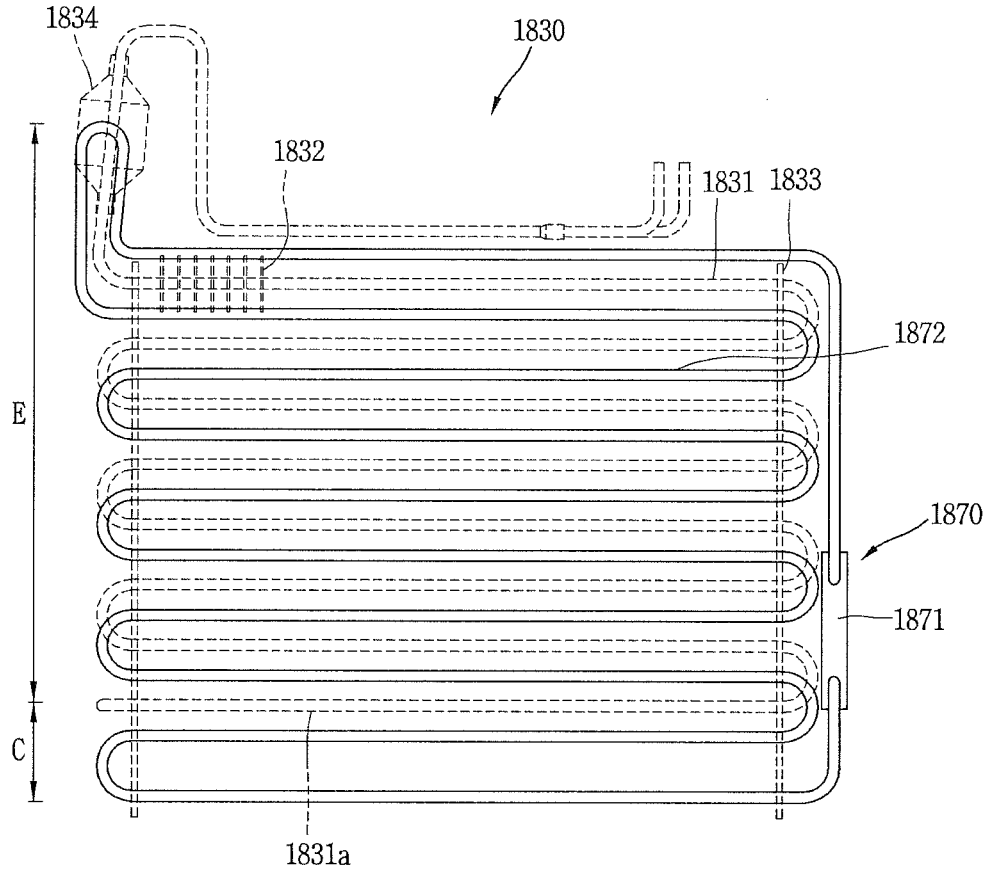
FIGS. 32 and 33 are a front view and a perspective view illustrating a fourth embodiment of a defrosting device applied to the refrigerator in FIG. 1 and FIGS. 34 and 35 are a front view and a perspective view illustrating an example in which the formation position of the heating unit is modified in the defrosting device illustrated in FIGS. 32 and 33.
Figure 33:
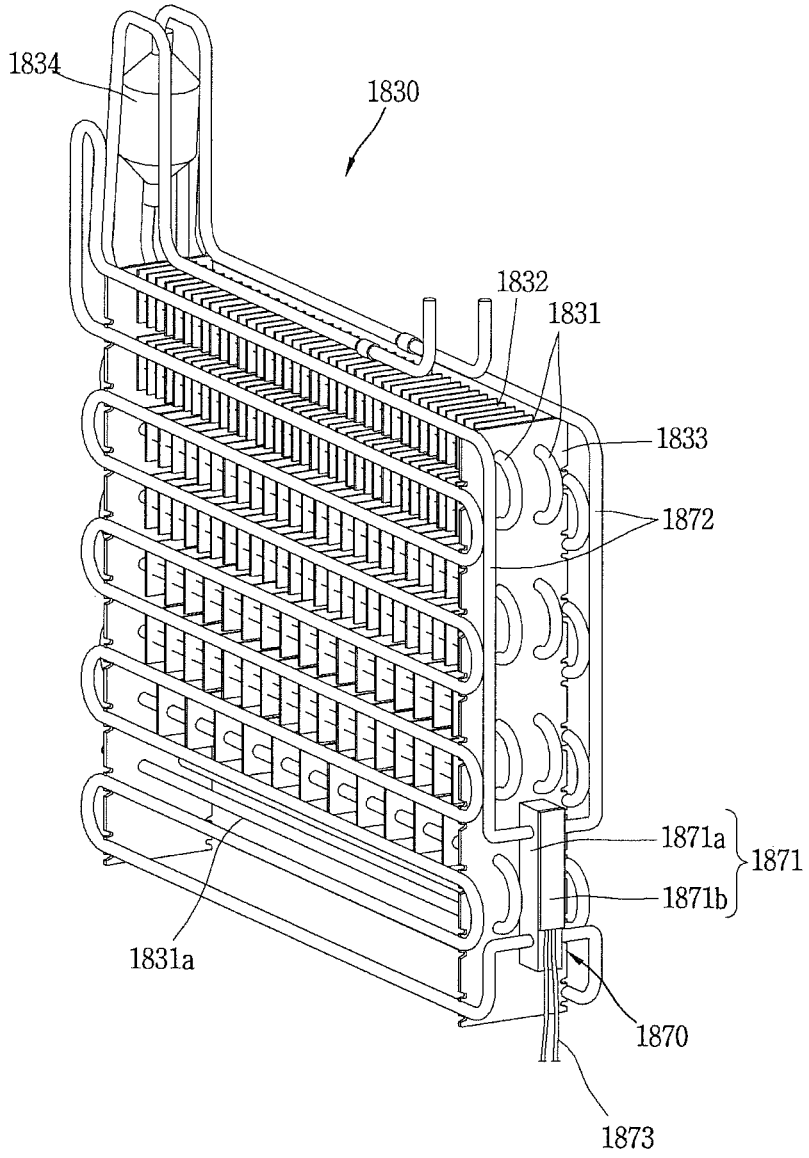

FIGS. 32 and 33 are a front view and a perspective view illustrating a fourth embodiment 1870 of the defrosting device 170 applied to the refrigerator 100 in FIG. 1. FIG. 32 illustrates a view in which part of a cooling fin 1832 is omitted. For reference, the detailed configuration of an evaporator 1830 is illustrated in more detail in FIG. 33.

Referring to FIGS. 32 and 33, a heat pipe 1872 may be divided into a high-temperature evaporator (E) and a low-temperature condenser (C) in the aspect according to the phase of circulating working fluid (F).

An evaporator (E) as a portion in which working fluid (F) moves in a phase containing a high-temperature gas or high-temperature gas and liquid has a temperature capable of removing frost on the cooling tube 1831. Structurally, the evaporator (E) is connected to an outlet of a heating unit 1871, and disposed to correspond to the cooling tube 1831 of the evaporator 1830 to transfer heat to the cooling tube 1831 of the evaporator 1830.

On the contrary, a condenser (C) as a portion in which working fluid (F) flows in a low-temperature liquid phase has a temperature lower than that capable of performing defrosting on the cooling tube 1831. Accordingly, even when the condenser (C) is disposed adjacent to the cooling tube 1831, defrosting on the cooling tube 1831 may not be efficiently carried out. The condenser (C) is finally connected to an inlet of the heating unit 1871.

A heat pipe 1872 is extended in a zigzag shape from the top to the bottom, and thus when the heat pipe 1872 is arranged to correspond to the cooling tube 1831, the condenser (C) is disposed adjacent to a lower side of the cooling tube 1831. It denotes that defrosting on the lower cooling tube 1831 cannot be efficiently carried out.

In order to solve this, the condenser (C) is extended from the evaporator (E) and disposed lower than the lowest column cooling tube 1831*a* of the evaporator 1830. The condenser (C) is configured to including at least two horizontal tubes disposed lower than the lowest column cooling tube 1831*a*. According to the present embodiment, it is shown a structure in which two columns of the heat pipes 1872 are further provided lower than the lowest column of the cooling tube 1831 of the evaporator 1830 to constitute the condenser (C).

As described above, when the low-temperature condenser (C) of the heat pipe 1872 is disposed lower than the lowest column cooling tube 1831*a* of the evaporator 1830, only the high-temperature evaporator (E) may be used for defrosting of the evaporator 1830, and thus defrosting on a lower side of the cooling tube 1831 may be efficiently carried out.

According to the foregoing structure, a lower end of the heating unit 1871 is disposed adjacent to the lowest column cooling tube 1831*a*. Accordingly, a return portion of the heat pipe 1872 is extended in an upward bent shape from the lowest column horizontal tube of the condenser (C) to an inlet of the heating unit 1871 to form a passage capable of collecting the condensed working fluid (F).

A large flow resistance is formed at a portion having a bent shape on the return portion, and thus there is an advantage of suppressing working fluid (F) returned to an inlet of the heating unit 1871 from flowing backward.

Figure 34:
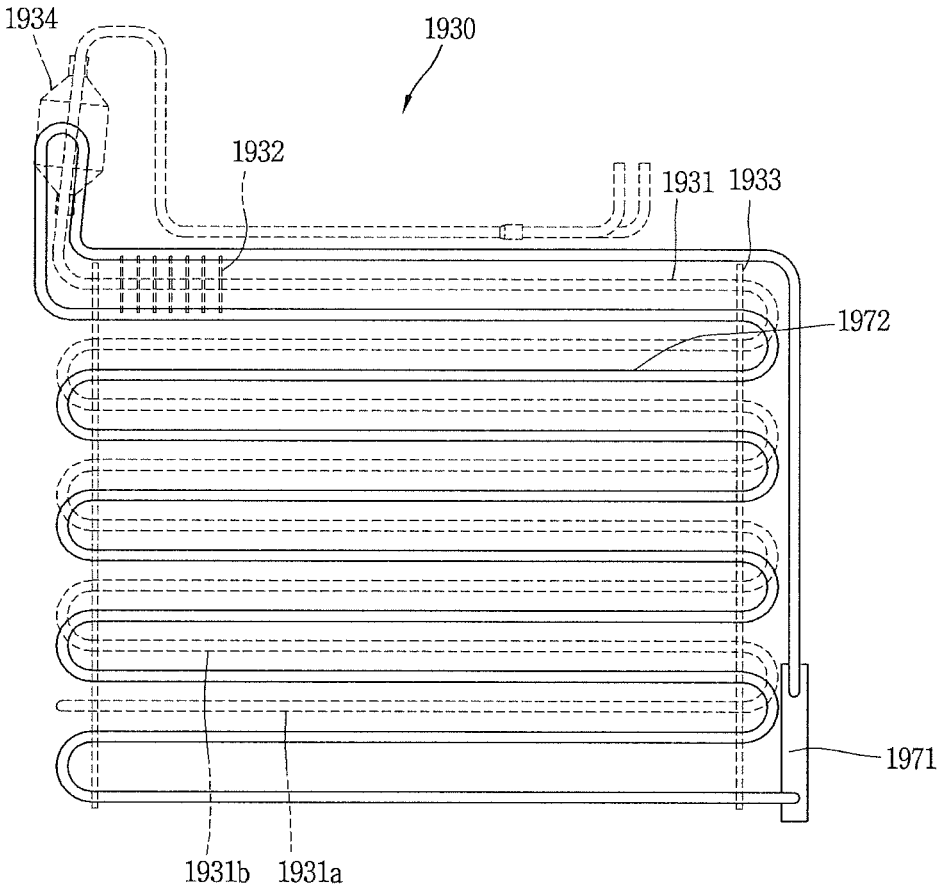
Figure 35:
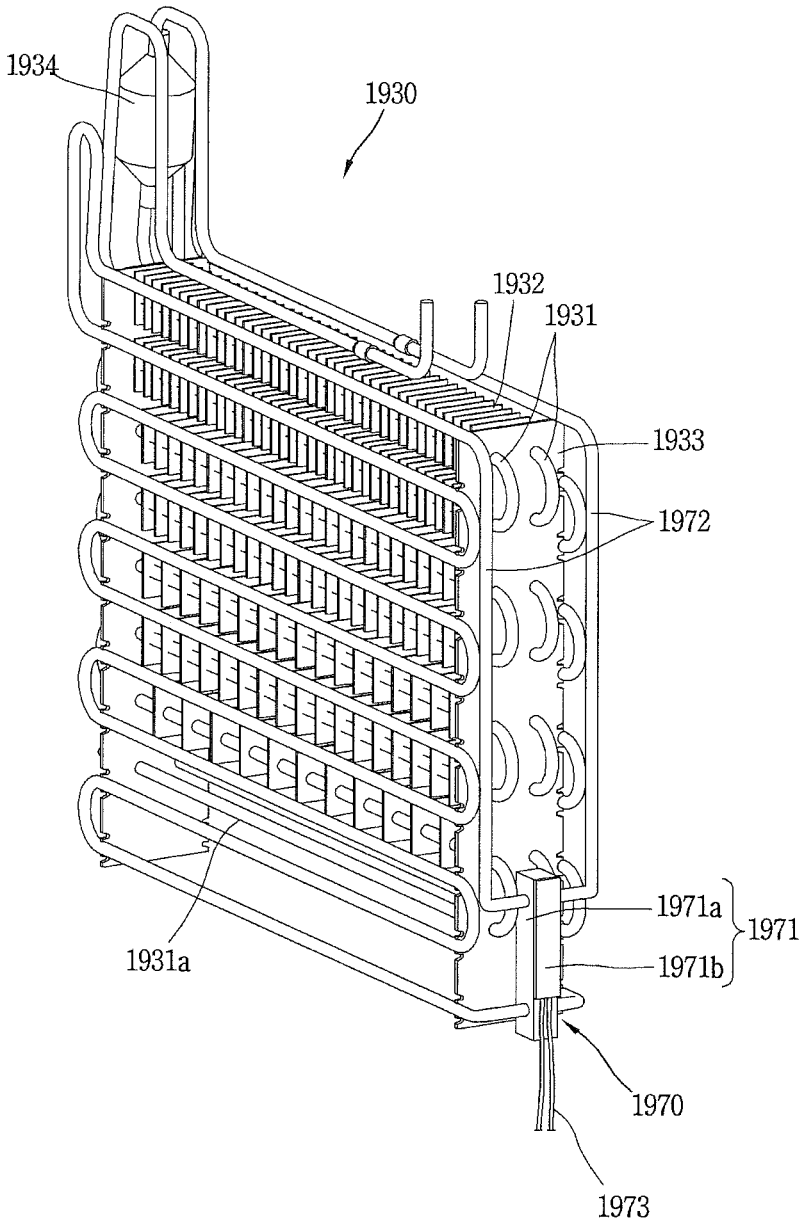

FIGS. 34 and 35 are a front view and a perspective view illustrating an example 1970 in which the formation position of the heating unit 1971 is modified in the defrosting device 1870 illustrated in FIGS. 32 and 33.

Referring to FIGS. 34 and 35, at least part of the heating unit 1971 is disposed lower than the lowest column cooling tube 1931 of an evaporator 1930. For an example, a lower end of the heating unit 1971 may be located adjacent to the lowest column horizontal tube of a heat pipe 1972, and an upper end of the heating unit 1971 may be located below the first cooling tube 1931*b* on the top (namely, second cooling tube on the bottom) from the lowest column cooling tube 1931*a* of the evaporator 1930.

According to the foregoing structure, a return portion connected between the lowest column horizontal tube of the heat pipe 1972 and an inlet of the heating unit 1971 is formed to be shorter than the return portion of the previous embodiment.

When the lowest column horizontal tube of the heat pipe 1972 and an inlet of the heating unit 1971 are placed on the substantially same level, a return portion may be extended from the lowest column horizontal tube of the heat pipe 1972 in a horizontal direction and connected to the inlet of the heating unit 1971.

Furthermore, according to the foregoing structure, it is configured such that the heating unit 1971 is disposed adjacent to the lowest column horizontal tube of the heat pipe 1972, and thus a heater 1971*b* is located below a water level of working fluid (F) with a smaller amount of working fluid (F) compared to the previous embodiment. Furthermore, a temperature of the lowest column horizontal tube of the heat pipe 1972 may further increase as a filling amount of working fluid (F) decreases. It denotes that a lower temperature of the evaporator (E) increases compared to the previous examples.

The invention claimed is:

1. A defrosting device, comprising:

a heating unit provided in an evaporator; and a heat pipe, both end portions of which are connected to an inlet and an outlet of the heating unit, respectively, and at least part of which is disposed adjacent to a cooling tube to dissipate heat to the cooling tube of the evaporator due to high-temperature working fluid heated and transferred by the heating unit, wherein the heating unit comprises:

a heater case provided with a vacant space, and provided with the inlet and the outlet at positions separated from each other, respectively, along a length direction; and a heater attached to an outer surface of the heater case to heat working fluid within the heater case, wherein the heater case is divided into an active heating part corresponding to a portion on which a hot wire is disposed and a passive heating part corresponding to a portion on which the hot wire is not disposed, and the inlet is formed on the passive heating part to prevent working fluid being moved through the heat pipe and then returned through the inlet from being reheated to flow backward;

wherein the heater comprises:

a base plate formed of a ceramic material, and attached to an outer surface of the heater case;

the hot wire formed on the base plate, and configured to dissipate heat during the application of power; and a terminal provided on the base plate to electrically connect the hot wire to the power.

2. The defrosting device of claim 1, wherein the hot wire is extended and formed from one point between the inlet and the outlet toward the outlet.

3. The defrosting device of claim 1, wherein the heater is attached to a bottom surface of the heater case.

4. The defrosting device of claim 3, wherein a first and a second extension fin extended and formed downward from a bottom surface and configured to cover both lateral surfaces of the heater attached to the bottom surface are provided at both sides of the heater case, respectively.

5. The defrosting device of claim 4, wherein a sealing member is filled to cover the heater on a rear surface of the heater and a recessed space formed by the first and the second extension fin, and an insulating material is interposed between the rear surface of the heater and the sealing member.

6. The defrosting device of claim 4, wherein the heater case comprises:

a main case provided with the vacant space, both end portions of which have an open shape, and to a bottom surface of which the heater is adhered; and a first cover and a second cover mounted to cover both open end portions of the main case, respectively.

7. The defrosting device of claim 1, wherein an outer fin is protruded and formed on another outer surface of the heater case to which the heater is not adhered.

8. The defrosting device of claim 7, wherein the heater is attached to a bottom surface of the heater case, and the outer fin is formed on an upper surface of the heater case.

9. The defrosting device of claim 7, wherein a plurality of outer fins are provided thereon, and extended and formed along a length direction or width direction of the heater case with a predetermined separation distance from each other, and the separation distance is set to be the same as or larger than a width of the outer fin.

10. The defrosting device of claim 1, wherein an inner fin is protruded and formed on an inner surface at an inner side of the outer surface.

11. The defrosting device of claim 10, wherein the heater is attached to an outer bottom surface of the heater case, and the inner fin is protruded and formed from an inner bottom surface of the heater case.

12. The defrosting device of claim 11, wherein the inner fin is protruded and formed with a length less than ½ compared to an inner height of the heater case.

13. The defrosting device of claim 11, wherein a plurality of inner fins are provided thereon, and extended and formed along a length direction of the heater case with a predetermined separation distance from each other, and a distance from an inner wall of the heater case to the inner fin adjacent to the inner wall is formed to be greater than one time but less than two times compared to a width of the inner fin, and a separation distance between each other of the plurality of inner fins is formed to be greater than one time but less than two times compared to the width of the inner fin.

* * * * *